US006545947B1

(12) United States Patent
Morozumi et al.

(10) Patent No.: US 6,545,947 B1
(45) Date of Patent: Apr. 8, 2003

(54) ACOUSTIC MATCHING MATERIAL, METHOD OF MANUFACTURE THEREOF, AND ULTRASONIC TRANSMITTER USING ACOUSTIC MATCHING MATERIAL

(75) Inventors: Hideki Morozumi, Yamatokoriyama (JP); Daisuke Bessyo, Kitakatsuragi-gun (JP); Kenzo Ohji, Ikoma (JP); Takeshi Nagai, Kitakatsuragi-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/889,077

(22) PCT Filed: Nov. 10, 2000

(86) PCT No.: PCT/JP00/07981

§ 371 (c)(1),
(2), (4) Date: Oct. 17, 2001

(87) PCT Pub. No.: WO01/37609

PCT Pub. Date: May 25, 2001

(30) Foreign Application Priority Data

| | | |
|---|---|---|
| Nov. 12, 1999 | (JP) | 11-322564 |
| Nov. 17, 1999 | (JP) | 11-326339 |
| Jun. 1, 2000 | (JP) | 2000-164276 |
| Oct. 2, 2000 | (JP) | 2000-303242 |
| Oct. 3, 2000 | (JP) | 2000-303341 |
| Oct. 18, 2000 | (JP) | 2000-317451 |

(51) Int. Cl.[7] ..... H04R 17/00
(52) U.S. Cl. ..... 367/152; 367/140
(58) Field of Search ..... 367/152, 140; 73/290; 310/334

(56) References Cited

U.S. PATENT DOCUMENTS

| | | | | |
|---|---|---|---|---|
| 5,375,099 A | | 12/1994 | Gill | 367/152 |
| 5,664,456 A | * | 9/1997 | Eckert | 367/152 |
| 5,860,584 A | * | 1/1999 | Inazuru | 228/121 |

FOREIGN PATENT DOCUMENTS

| | | | |
|---|---|---|---|
| GB | 2225426 A * | 5/1990 | G01K/11/02 |
| JP | 3-295547 | 12/1991 | |

* cited by examiner

*Primary Examiner*—Ian J. Lobo
(74) *Attorney, Agent, or Firm*—Snell & Wilmer, LLP

(57) ABSTRACT

An acoustic matching member 1 is used, when a sound is propagated from a first object to a second object, for matching an acoustic impedance of the first object and an acoustic impedance of the second object. The acoustic matching member 1 includes a plurality of fine pieces 2, and at least one of the plurality of fine pieces 2 is bonded with at least another of the plurality of fine pieces at a contact portion so as to form a gap in the acoustic matching member 1.

16 Claims, 20 Drawing Sheets

ACOUSTIC MATCHING MATERIAL, METHOD OF MANUFACTURE THEREOF, AND ULTRASONIC TRANSMITTER USING ACOUSTIC MATCHING MATERIAL

TECHNICAL FIELD

The present invention relates to an acoustic matching member used, when a sound is propagated from one object to another object, for matching acoustic impedances of the two objects, a method for producing the acoustic matching member, and an ultrasonic transmitting and receiving device using the acoustic matching member.

BACKGROUND ART

An acoustic impedance of an object is obtained by (density×sonic speed). The acoustic impedance of air $Z_{AIR}$ is about 428 kg/m$^2$s, and the acoustic impedance of a piezoelectric vibrator $Z_{PZT}$ for generating an ultrasonic wave is about $30\times10^6$ kg/m$^2$s.

When an ultrasonic wave is radiated from the piezoelectric vibrator into the air, sound reflection is generated by the difference between the acoustic impedance of the piezoelectric vibrator $Z_{PZT}$ and the acoustic impedance of air $Z_{AIR}$, and thus the radiation efficiency of the sound is reduced.

The acoustic matching member is used to alleviate the reduction in the radiation efficiency of the sound by matching the acoustic impedance of the piezoelectric vibrator $Z_{PZT}$ and the acoustic impedance of air $Z_{AIR}$.

An acoustic impedance of an acoustic matching member $Z_M$ is obtained by expression (1) based on theoretical calculation.

$$Z_M=\sqrt{(Z_{PZT}\times Z_{AIR})} \qquad \text{expression (1)}$$

Here, the value of $Z_M$ is an ideal value at which there is no sound reflection. Using the above-mentioned values of $Z_{PZT}$ and $Z_{AIR}$, the value of $Z_M$ is about $0.11\times10^6$ kg/m$^2$s.

FIG. 29 is a graph illustrating the relationship between the acoustic impedance of the acoustic matching member and the ratio of the sound energy radiated from the piezoelectric vibrator into the air (transmission ratio). It is appreciated from FIG. 29 that when the acoustic impedance of the acoustic matching member is about $0.11\times10^6$ kg/m$^2$s, the transmission ratio is 1, at which there is no sound reflection.

In order to obtain an acoustic matching member having such an ideal acoustic impedance, a material having a low density and allowing a low sonic speed needs to be selected for such an acoustic matching member.

FIG. 30 shows an example of a conventional acoustic matching member. The acoustic matching member shown in FIG. 30 is obtained by mixing glass balloons 121 in a resin material 120 and solidifying the resultant mixture.

The glass balloons are hollow and thus have a feature of being very lightweight. A structure obtained by mixing the glass balloons in the resin material and solidifying the resultant mixture has a lower density than that of a structure obtained by solidifying only the resin material. The size of the glass balloons is set to a value which is sufficiently smaller than the wavelength of the vibration (sound) propagating through the acoustic matching member (about 1/10 of the wavelength of the vibration or less). The size of the glass balloons is set to such a value in order to make the propagation of the vibration less liable to the influence of the glass balloons.

When glass balloons having a true density of 0.13 g/cm$^3$ ("Scotchlight™ Glass Bubbles Filler" available from Sumitomo 3M Ltd.) are mixed in a resin material allowing a sonic speed of about 2300 m/s and having a density of 1.2 g/cm$^3$, and the resultant mixture is solidified, a structure having a density of 0.56 g/cm$^3$ and allowing a sonic speed of 2100 m/s is obtained. An acoustic impedance $Z_{COM}$ of the structure thus obtained is $1.18\times10^6$ kg/m$^2$s.

Japanese Laid-Open Publication No. 2-177799 describes that an acoustic matching member is formed using only hollow glass spheres. This acoustic matching member is produced by heating the hollow spheres up to a temperature for softening the hollow glass spheres, compressing the hollow spheres, and binding the plurality of hollow spheres at respective contact points. As the hollow glass spheres, "Scotchlight™ Glass Bubbles Filler" available from Sumitomo 3M Ltd. is used. Japanese Laid-Open Publication No. 2-177799 describes that the acoustic matching member thus produced has characteristics of a sonic speed of 900 m/s and an acoustic impedance $Z_{BG}$ of about $0.45\times10^6$ kg/m$^2$s. Since the acoustic impedance of an object is represented by (sonic speed×density), the density of this acoustic matching member is 0.5 g/cm$^3$.

As described above, the sonic speed allowed by glass is 5000 to 6000 m/s, but the sonic speed allowed by an acoustic matching member is reduced to 900 m/s by producing the acoustic matching member using hollow glass spheres.

An acoustic matching member can be bonded to a vibrator or a case accommodating the vibrator with an adhesive formed of a resin material such as an epoxy resin. Japanese Laid-Open Publication No. 2-177799 describes an example of heating the plurality of hollow spheres up to a temperature for softening the plurality of hollow spheres and binding the plurality of hollow spheres at respective contact points as well as bonding the acoustic matching member to a vibrator. By such a bonding method, the acoustic matching member is formed only of glass, and thus has superior temperature characteristics to those of an acoustic matching member formed using a resin material. The reason is that the thermal expansion ratio of glass is lower than the thermal expansion ratio of the resin material. When the flow rate of a gas is measured using an ultrasonic transmitting and receiving device, the temperature characteristics of the ultrasonic transmitting and receiving device significantly influences the measurement precision. In order to accurately measure a very small flow rate of gas, the temperature characteristics of the ultrasonic transmitting and receiving device need to be small.

Some types of gases are explosive. A vibrator which needs to provide such a gas with an electric signal is required to be accommodated in a case in order to prevent the vibrator from contacting the gas. Conditions to be satisfied by the material of the case include a high strength against breakage and satisfactory temperature characteristics. For this reason, metal is preferable as a material of the case. The thermal expansion ratio of metal is different from the thermal expansion ratio of glass. Therefore, a metal case and the acoustic matching member come apart from each other and cannot be bonded together at the stage of binding the plurality of hollow spheres at respective contact points after the plurality of hollow spheres are heated to a temperature for softening the plurality of hollow spheres as in the method described in Japanese Laid-Open Publication No. 2-177799.

When the acoustic impedances $Z_{BG}$ and $Z_{COM}$ of the above-described acoustic matching materials are plotted in the graph of FIG. 29, $Z_{BG}$ is positioned at A and $Z_{COM}$ is positioned at ■. The transmission ratio is 0.21 for $Z_{BG}$ and 0.05 for $Z_{COM}$. Thus, the transmission ratio (i.e., the transmission ratio of sound) for $Z_{BG}$ is four times the transmission ratio for $Z_{COM}$. However, in actuality, an output which is four times larger is not obtained, but the outputs are of an equivalent level for $Z_{BG}$ and $Z_{COM}$. This is considered to occur since the structure having $Z_{BG}$ is more likely to cause the sound to attenuate when the sound is propagated therethrough than the structure having $Z_{COM}$. By contrast, the structure having $Z_{COM}$ is less likely to cause the sound to attenuate while the sound is propagated therethrough but allows a higher sonic speed than the structure having $Z_{BG}$. Therefore, the structure having $Z_{COM}$ has a larger acoustic impedance and causes the sound radiated into the air to be reflected more than the structure having $Z_{BG}$.

In the end, there is no significant difference in the sound outputs of the both types of acoustic matching members. Therefore, an acoustic matching member providing a large sound output is demanded rather than the acoustic matching member formed of the structure having $Z_{BG}$ or $Z_{COM}$ One possible reason why the structure having $Z_{BG}$ causes the sound to significantly attenuate is that because the hollow spheres bound at only the respective contact points and thus the total number of contact points are relatively small.

As described above, the conventional ultrasonic transmitting and receiving device has the following problems.

First, when the acoustic matching member is formed using a resin material, the measurement precision of the ultrasonic transmitting and receiving device is not satisfactory due to the temperature characteristics of the resin material.

Second, when the acoustic matching member is formed of only hollow glass spheres, sound is significantly attenuates due to a small number of contact points of the hollow spheres.

Third, when the vibrator is accommodated in a metal case so as to prevent the vibrator from contacting the gas, bonding of the acoustic matching member to the metal case with an adhesive formed of a resin material such as an epoxy resin deteriorates the measurement precision of the ultrasonic transmitting and receiving device due to the temperature characteristics of the adhesive.

Fourth, the metal case and the acoustic matching member come apart from each other and cannot be bonded together at the stage of binding the plurality of hollow spheres at respective contact points after the plurality of hollow spheres are heated to a temperature for softening the plurality of hollow spheres, due to the difference in thermal expansion ratio of the metal case and glass, which is the material of the hollow spheres. Even when the metal case and the acoustic matching member are bonded, flexure is generated and thus the vibration of the vibrator is not propagated.

The present invention has been made in order to solve the first through fourth problems.

DISCLOSURE OF THE INVENTION

An acoustic matching member according to the present invention is used, when a sound is propagated from a first object to a second object, for matching an acoustic impedance of the first object and an acoustic impedance of the second object. The acoustic matching member includes a plurality of fine pieces. At least one of the plurality of fine pieces is bonded with at least another of the plurality of fine pieces at a contact portion so as to form a gap in the acoustic matching member.

The plurality of fine pieces may each have an amorphous three-dimensional structure.

The plurality of fine pieces may be located so as to prevent the sound from being linearly propagated through the acoustic matching member.

The plurality of fine pieces may each be formed of a glass or a ceramic material.

A method for producing an acoustic matching member according to the present invention is used, when a sound is propagated from a first object to a second object, for matching an acoustic impedance of the first object and an acoustic impedance of the second object. The method includes the steps of (a) forming a plurality of fine pieces; (b) heating the plurality of fine pieces to a temperature for softening the plurality of fine pieces, thereby bonding at least one of the plurality of fine pieces with at least another of the plurality of fine pieces at a contact portion so as to form a gap in the acoustic matching member.

The step (b) may include the step of heating the plurality of fine pieces while applying a load on the plurality of fine pieces.

The step (a) may include the steps of mixing the plurality of fine pieces and a liquid; and vaporizing the liquid from a mixture of the plurality of fine pieces and the liquid.

A specific gravity of the liquid may be smaller than a specific gravity of the plurality of fine pieces.

The liquid may be vaporized after the plurality of fine pieces are precipitated in the liquid.

The plurality of fine pieces may be formed by pulverizing a plurality of hollow spheres.

A density of the acoustic matching member may be controlled in accordance with a degree to which the plurality of hollow spheres are pulverized.

The degree to which the plurality of hollow spheres is pulverized may be expressed by a ratio between a volume of the plurality of hollow spheres before being pulverized and a volume of the plurality of fine pieces obtained by pulverizing the plurality of hollow spheres.

An ultrasonic transmitting and receiving device according to the present invention includes a vibrator; a metal case for accommodating the vibrator; an acoustic matching member used for matching an acoustic impedance of the vibrator and an acoustic impedance of a fluid flowing outside the metal case; and a bonding member for bonding the acoustic matching member and the metal case. The acoustic matching member includes a plurality of fine pieces, and at least one of the plurality of fine pieces is bonded with at least another of the plurality of fine pieces at a contact portion so as to form a gap in the acoustic matching member. The bonding member has a structure for reducing a difference between a thermal expansion ratio of the metal case and a thermal expansion ratio of the acoustic matching member.

The bonding member may include a first layer formed on the metal case, a second layer formed on the first layer, and a third layer formed on the second layer. The first layer may be formed of silver solder. The second layer may be formed of titanium. The third layer may be formed of silver solder.

The bonding member may further include a fourth layer formed on the third layer and a fifth layer formed on the fourth layer. The fourth layer may be a ceramic plate or a glass plate. The fifth layer may be formed of glass having a melting point lower than a melting point of the material of the fourth layer.

The bonding member may include a first layer formed on the metal case, and the first layer may be formed based on a mixture obtained by mixing silver solder powder and titanium powder.

The bonding member may include a first layer formed on the metal case, and the first layer may be formed based on a mixture obtained by mixing silver solder powder, titanium powder and ceramic powder.

The bonding member may include a first layer formed on the metal case and a second layer formed on the first layer, and a bonding face between the first layer and the second layer may have a convexed and concaved shape.

The first layer may be formed on the metal case intermittently.

The first layer may contain a plurality of particles having a thermal expansion ratio lower than a thermal expansion ratio of the material of the first layer.

The bonding member may include a first layer formed on the metal case and a second layer formed on the first layer. The first layer may be formed by heating a mixture containing a first particle of a first material which is easily oxidized, nitrided or carbided and a second particle of a second material having a specific gravity larger than a specific gravity of the first material and having a melting point lower than a melting point of the first material, the first layer being formed as a layer of the second material. The second layer may be formed on the layer of the second material, the second layer being formed as a layer obtained as a result of oxidizing, nitriding or carbiding the first material.

The first material may have a thermal expansion ratio which is lower than a thermal expansion ratio of the second material.

The mixture may be heated at a temperature which is lower than the melting point of the first material and higher than the melting point of the second material.

The first particle may have a size of 150 $\mu$m or less.

BEST MODE FOR CARRYING OUT THE INVENTION

Hereinafter, example of the present invention will be described with reference to the figures.

EXAMPLE 1

Figure 1:
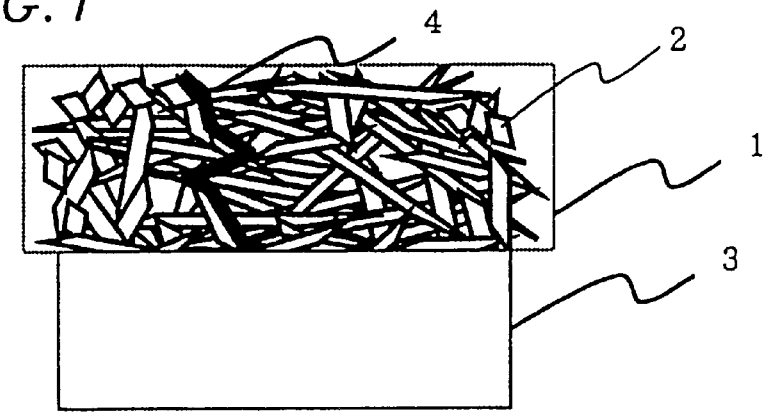
FIG. 1 is a cross-sectional view of an acoustic matching member 1 according to a first example of the present invention.

FIG. 1 shows a cross-section of an acoustic matching member 1 according to a first example of the present invention. The acoustic matching member 1 is attached to a vibrator 3.

The acoustic matching member 1 is used, when a sound is propagated from a first object (for example, the vibrator 3) to a second object (for example, air), for matching an acoustic impedance of the first object and an acoustic impedance of the second object.

The acoustic matching member 1 includes a plurality of fine pieces 2. The plurality of fine pieces 2 each have a structure having a planar face. The plurality of fine pieces 2 are each bonded to at least one other fine piece 2 at a contact portion.

The contact can be a point-to-point contact, a line-to-line contact, or a face-to-face contact. What is required is that a gap is formed in the acoustic matching member 1 by bonding the plurality of fine pieces 2 to each other. The gap can be formed in the acoustic matching member 1 by locating the fine pieces 2 irregularly as shown in FIG. 1.

Figure 28A:
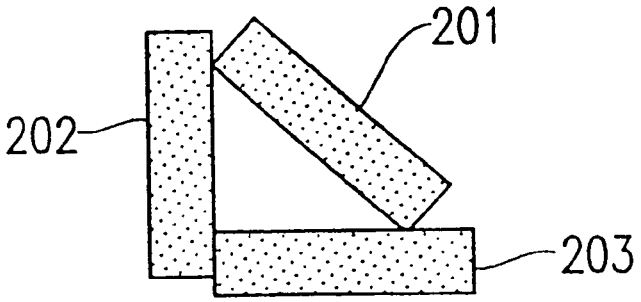
FIG. 28A shows an example of a contact state of fine pieces 2 (fine pieces 201 through 203) for forming a gap in the acoustic matching member 1.
Figure 28B:
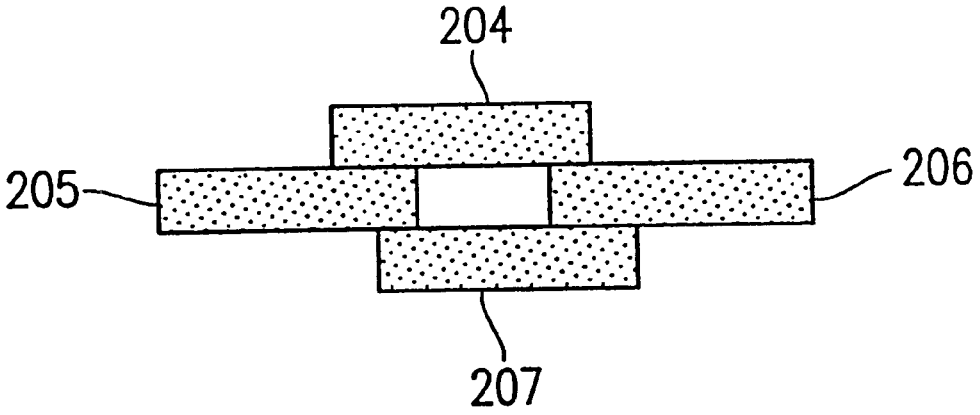
FIG. 28B shows an example of a contact state of fine pieces 2 (fine pieces 204 through 207) for forming a gap in the acoustic matching member 1.
Figure 28C:
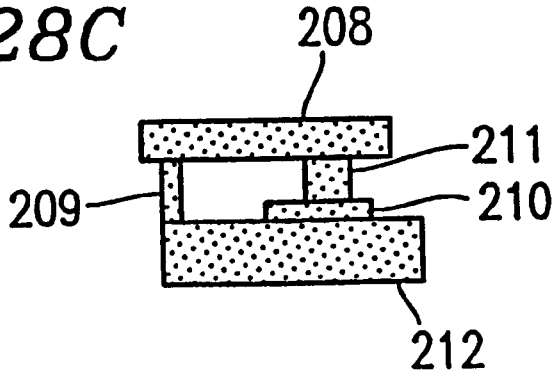
FIG. 28C shows an example of a contact state of fine pieces 2 (fine pieces 208 through 212) for forming a gap in the acoustic matching member 1.

FIGS. 28A through 28C each show an example of a contact state of the fine pieces 2 (fine pieces 201 through 212) for forming a gap in the acoustic matching member 1.

In the example shown in FIG. 28A, the fine pieces 201 and 202 are bonded together in the state where a corner of the fine piece 201 and a planar face of the fine piece 202 contact each other. The fine pieces 201 and 203 are bonded together in the state where another corner of the fine piece 201 and a planar face of the fine piece 203 contact each other. The fine pieces 202 and 203 are bonded together in the state where a planar face of the fine piece 202 having a longer length contacts a planar face of the fine piece 203 having a shorter length. Thus, a gap is formed by bonding the fine pieces 201 through 203 to each other.

In the example shown in FIG. 28B, the fine pieces 204 through 207 are bonded to each other in the state where planar faces of the fine pieces 204 through 207 partially contact each other. Thus, a gap is formed by bonding the fine pieces 204 through 207 to each other.

In the example shown in FIG. 28C, the fine pieces 208 through 212 are bonded to each other in the state where planar faces of the fine pieces 208 through 212 partially contact each other. Thus, a gap is formed by bonding the fine pieces 208 through 212 to each other.

Even when the fine pieces 2 have a planar shape, a gap can be formed by bonding the plurality of fine pieces 2 to each other. In this case, a gap can be easily formed by locating the fine pieces 2 irregularly and also by forming the fine pieces 2 to have irregular sizes. The contact between the fine pieces 2 can be a point-to-point contact, a line-to-line contact, or a face-to-face contact.

The plurality of fine pieces 2 are located so as not to linearly propagate the vibration (sound) of the vibrator 3 through the acoustic matching member 1. Therefore, a propagation path 4 is not linear but winding. As a result, the total speed of the sound propagating through the propagation path 4 in the acoustic matching member 1 is lower than the inherent sonic speed allowed by the material of the fine pieces 2.

For example, when the fine pieces 2 are formed of glass, the sonic speed allowed by the acoustic matching member 1 having the structure shown in FIG. 1 is lower than about 5000 m/s, which is the inherent sonic speed allowed by glass. Since the acoustic matching member 1 has gaps as shown in FIG. 1, the density of the acoustic matching member 1 is clearly lower than the density of a body having the same size and formed of the same material as the fine pieces 2. The acoustic impedance of an object is represented by (density×sonic speed), and thus the acoustic impedance of the acoustic matching member 1 can be smaller.

As the material of the fine pieces 2, plastic, metal, glass, or ceramic materials, for example, are usable.

Where the vibration frequency of the vibrator 3 is ν and the sonic speed is C, the wavelength λ of the sound is represented by expression (2).

$$\lambda = C/\nu \ldots \qquad \text{expression (2)}$$

Here, the sonic speed C shows the speed of the sound propagating through the acoustic matching member 1. It is now assumed that the acoustic matching member 1 is formed as a bulk of glass. Since the sonic speed allowed by glass is about 5000 m/s, the wavelength λ of the sound is 10 mm when the vibration frequency ν of the vibrator 3 is 500 kHz. When the acoustic matching member 1 is formed as an aggregation of the fine pieces 2 of glass, the sonic speed allowed by the acoustic matching member 1 is lower than about 5000 m/s, which is the sonic speed allowed by glass. For example, where the sonic speed allowed by the acoustic matching member 1 is 1000 m/s, the wavelength λ of the sound is 2 mm when ν is 500 kHz.

In order to cause the gap formed in the acoustic matching member 1 to have less influence on the propagation of the sound, the size of the gap needs to be sufficiently small as compared to the wavelength of the sound to be propagated. In order to make the size of the gap equal to or less than 200 μm, which is 1/10 of the wavelength of the sound, the length of each fine piece 2 is preferably 200 μm or less. In order to reduce the density of the acoustic matching member 1, the fine pieces 2 preferably have a smaller thickness, and is preferably formed of, for example, a glass plate having a thickness of about 1 μm.

In the first example, all the fine pieces 2 included in the acoustic matching member 1 do not need to be bonded to another fine piece 2 at a contact portion. Namely, the acoustic matching member 1 can include fine pieces 2 which are not bonded to another fine piece 2. An effect similar to the above-described effect is provided so long as at least one of the plurality of fine pieces 2 included in the acoustic matching member is bonded to at least one other fine piece 2 at a contact portion.

EXAMPLE 2

Figure 2:
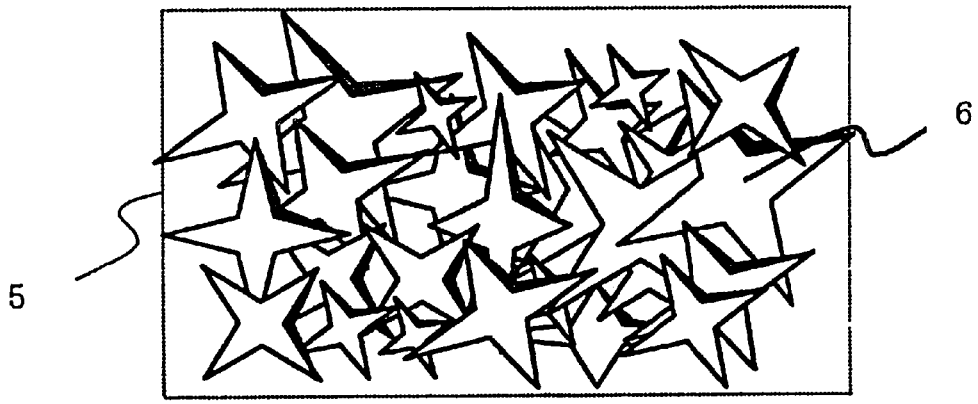
FIG. 2 is a cross-sectional view of an acoustic matching member 5 according to a second example of the present invention.

FIG. 2 shows a cross-section of an acoustic matching member 5 according to a second example of the present invention.

The acoustic matching member 5 includes a plurality of fine pieces 6. At least one of the plurality of fine pieces 6 is bonded to at least one other fine piece 6 at a contact portion so as to form a gap in the acoustic matching member 5.

In the second example, the plurality of fine pieces 6 each have a structure having a plurality of projections. The projections of the fine piece 6 contact another fine piece 6, and the fine pieces 6 contact each other at the contact portions. Thus, a gap can be formed around the projections. By providing each fine piece 6 with a plurality of projections, two adjacent fine pieces 6 can be in contact with each other at a plurality of contact portions. In this manner, the bonding strength can be increased as compared to the case where the fine pieces 6 are bonded at one contact portion.

The plurality of projections can be provided on a thin plate or on a cube. In these cases also, a gap can be formed around the projections of the fine pieces 6. As a result, the density of the acoustic matching member 5 can easily be reduced.

The contact between the fine pieces 6 can be a point-to-point contact, a line-to-line contact, or a face-to-face contact.

The operation and function of the acoustic matching member 5 are similar to the operation and function of the acoustic matching member 1 described in the first example. The size of the fine pieces 6 is preferably 200 $\mu$m or less as described above.

EXAMPLE 3

Figure 3:
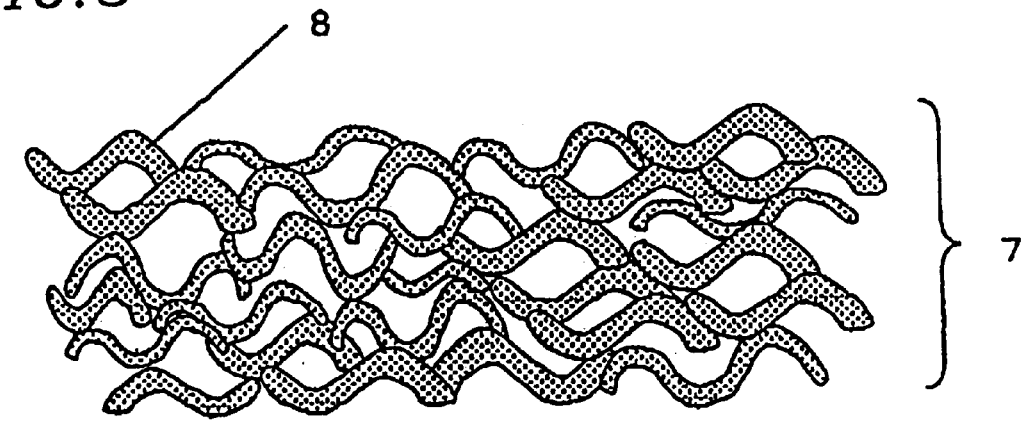
FIG. 3 is a cross-sectional view of an acoustic matching member 7 according to a third example of the present invention.

FIG. 3 shows a cross-section of an acoustic matching member 7 according to a third example of the present invention. The acoustic matching member 7 includes a plurality of fine pieces 8. At least one of the plurality of fine pieces 8 is bonded to at least one other fine piece 8 at a contact portion so as to form a gap in the acoustic matching member 7.

In the third example, the plurality of fine pieces 8 are each a thin plate having an amorphous convexed concaved structure. Thus, the plurality of fine pieces 8 each have an amorphous three-dimensional structure. By contacting a projection or end of a fine piece 8 with another fine piece 8, a gap can be easily be formed around the contact portion. By providing each fine piece 8 with the convexed portions and concaved portions, two adjacent fine pieces 8 can be in contact with each other at a plurality of contact portions. In this manner, the bonding strength can be increased as compared to the case where the fine pieces 8 are bonded at one contact portion. The number of the convexed portions and concaved portions is not limited to any specific value.

The contact between the fine pieces 8 can be a point-to-point contact, a line-to-line contact, or a face-to-face contact.

The operation and function of the acoustic matching member 7 are similar to the operation and function of the acoustic matching member 1 described in the first example. The size of the convexed portions and the concaved portions of the fine pieces 8 is preferably 200 $\mu$m or less as described above. The fine pieces 8 having the convexed and concaved structure are preferably plates having a minimum possible thickness. The thickness of the fine pieces 8 is preferably about 1 $\mu$m in order to reduce the density of the acoustic matching member 7.

For example, when the fine pieces 8 are formed of glass, the plurality of fine pieces 8 can be bound to each other by heating the plurality of fine pieces 8 up to a temperature at which glass is softened.

By heating the fine pieces 8 to a softening point of glass, the convexed and concaved structure of the fine pieces 8 can be prevented from being destroyed. At the contact portions of the fine pieces 8, the softened glass pieces are bound to each other.

By heating the fine pieces 8 while applying a slight load to the fine pieces 8, the binding of the fine pieces 8 at the contact portions can be strengthened. The reason is that the fine pieces 8 are softened by heating while being pressurized.

When the load on the fine pieces 8 is increased, the fine pieces 8 are deformed by the pressure while the convexed and concaved structure is not eliminated. In this case, the contact area between the fine pieces 8 is increased and the bonding strength at the contact portions is increased due to the load. Thus, the attenuation of the sound propagating through the contact portions of the fine pieces 8 can be reduced.

As described above, the bonding strength between the fine pieces 8 can be adjusted in accordance with the load applied on the fine pieces 8. However, when a load is applied on the fine pieces 8, the density of the acoustic matching member 7 is increased. As a result, an acoustic impedance of the acoustic matching member 7 is increased.

Figure 29:
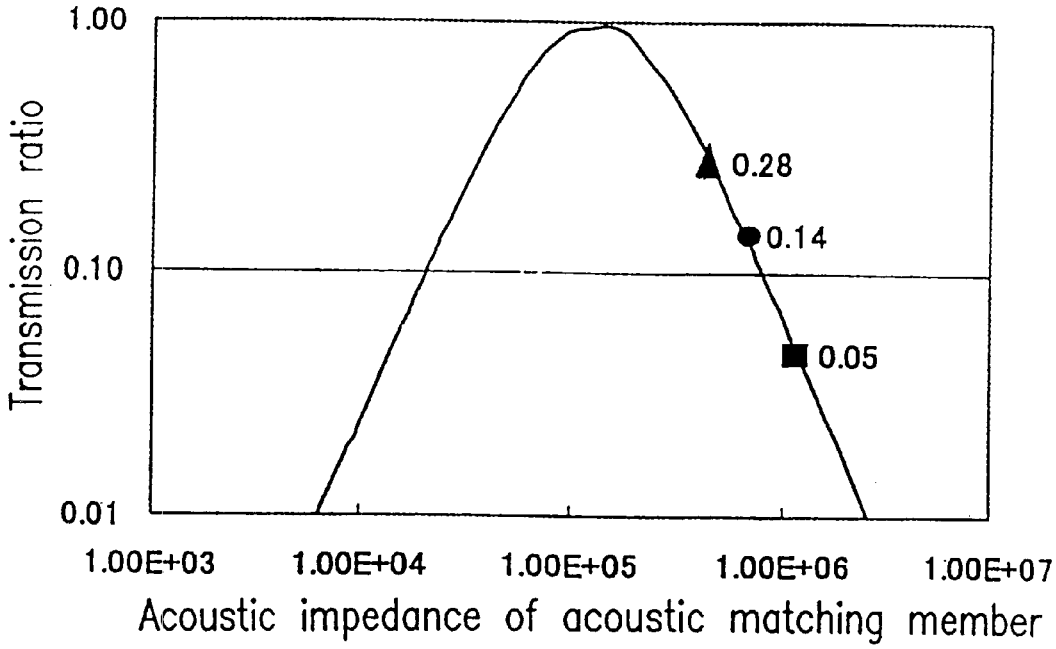
FIG. 29 is a graph illustrating the relationship between the acoustic impedance of an acoustic matching member and the ratio of sound energy radiated from the air from a piezoelectric vibrator (transmission ratio).

The acoustic matching member 7 shown in FIG. 3 is a structure formed by applying a load of 415 g/cm$^2$ at a temperature of 700° C. on an aggregation of the fine pieces 8 having a convexed and concaved structure formed of glass which is softened at about 700° C. The structure has a density of about 0.537 g/cm$^3$, allows a sonic speed of about 1224 m/s, and has an acoustic impedance $Z_{DEV}$ of $0.657\times10^6$ kg/m$^2$s. The acoustic impedance $Z_{DVE}$ is plotted in the graph of FIG. 29 with ●. The acoustic impedance $Z_{DVE}$ is between the acoustic impedances $Z_{BG}$ and $Z_{COM}$ described in the "Background Art" section. In order to compare the magnitudes of actual sound transmission, a voltage of an ultrasonic sensor at the receiving end was measured using a measurement device shown in FIG. 4.

Figure 4:
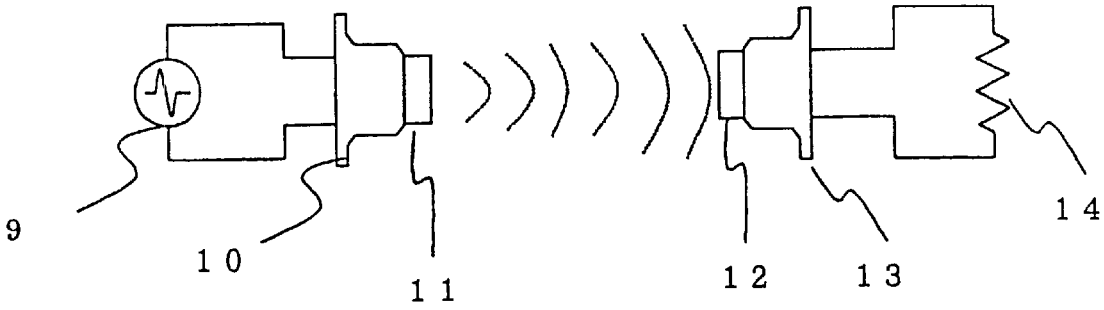
FIG. 4 shows a structure of a measurement device for measuring a sound output of an acoustic matching member.

As shown in FIG. 4, an acoustic matching member 11 to be tested is attached to an ultrasonic transmitting device 10. A standard acoustic matching member 12 is attached to an ultrasonic receiving device 13.

The ultrasonic transmitting device 10 transmits an ultrasonic wave in accordance with the voltage output from a signal source 9. The ultrasonic receiving device 13 receives the ultrasonic wave transmitted from the ultrasonic transmitting device 10. The ultrasonic wave received by the ultrasonic receiving device 13 is observed by measuring the voltages at both ends of a resistor 14 bound to the ultrasonic receiving device 13. Here, a distance between the ultrasonic transmitting device 10 and the ultrasonic receiving device 13 is about 10 mm.

Figure 5:
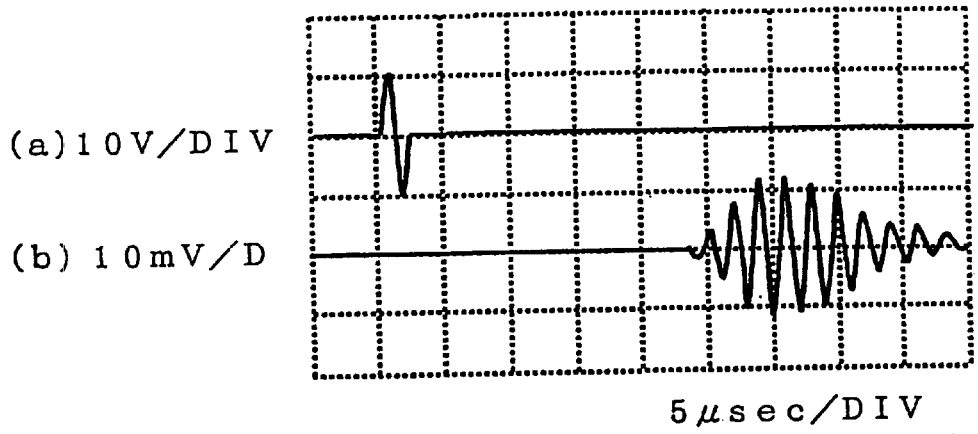
FIG. 5 shows measurement results obtained when a conventional acoustic matching member having an acoustic impedance $Z_{COM}$ is used as an acoustic matching member 11 to be tested.
Figure 30:
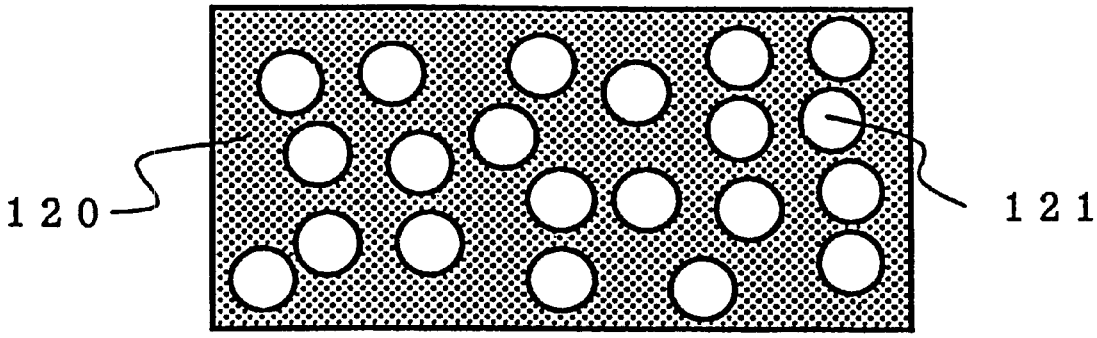
FIG. 30 shows an exemplary structure of a conventional acoustic matching member.

FIG. 5 shows measurement results obtained when the conventional acoustic matching member having the acoustic impedance $Z_{COM}$ described with reference to FIG. 30 was used as the acoustic matching member 11 to be tested. In FIG. 5, (a) shows a waveform of the voltage from the signal source 9, and (b) shows a waveform of the voltages at both ends of the resistor 14 (i.e., the output waveform from the ultrasonic receiving device 13).

Figure 6:
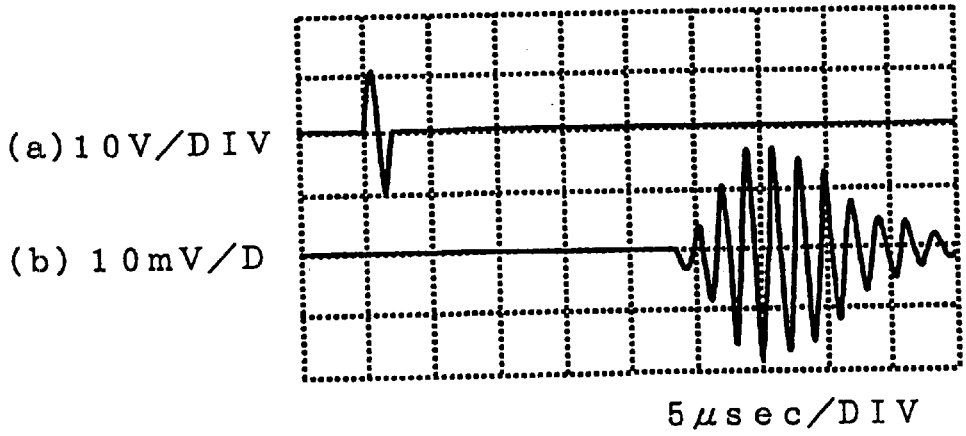
FIG. 6 shows measurement results obtained when the acoustic matching member 7 having an acoustic impedance $Z_{DVE}$ is used as the acoustic matching member 11 to be tested.

FIG. 6 shows measurement results obtained when the acoustic matching member 7 having the acoustic impedance $Z_{DVE}$ shown in FIG. 3 was used as the acoustic matching member 11 to be tested. In FIG. 6, (a) shows a waveform of the voltage from the signal source 9 (the same waveform as that in (a) of FIG. 5), and (b) shows a waveform of the voltages at both ends of the resistor 14 (i.e., the output waveform from the ultrasonic receiving device 13).

The maximum value of the amplitude of the voltage waveform shown in (b) of FIG. 5 is 23 mV, and the maximum value of the amplitude of the voltage waveform shown in (b) of FIG. 6 is 33 mV. From this, it is appreciated that the acoustic matching member 7 having the acoustic impedance $Z_{DVE}$ is superior to the conventional acoustic matching member having the acoustic impedance $Z_{COM}$ in the output level.

The measurement results obtained when the conventional acoustic matching member having the acoustic impedance $Z_{BG}$ was used are substantially the same as the measurement results obtained when the conventional acoustic matching member having the acoustic impedance $Z_{COM}$ was used.

From this, it is appreciated that the acoustic matching member 7 having the acoustic impedance $Z_{DVE}$ is superior to the conventional acoustic matching member having the acoustic impedance $Z_{BG}$ in the output level.

Simply considering only the magnitude of the acoustic impedance, the conventional acoustic matching member having the acoustic impedance $Z_{BG}$ should have the highest output level of the two. However, the actual measurement results are different from that. It is considered that this occurs because in the acoustic matching member 7 having the acoustic impedance $Z_{DVE}$, the bonding strength of the aggregation of the fine pieces is stronger and thus the sound attenuation while the sound is propagated is smaller than in the conventional acoustic matching member having the acoustic impedance $Z_{BG}$. The conventional acoustic matching member having the acoustic impedance $Z_{BG}$ has a structure in which hollow spheres are assembled in a matrix and bound at the contact point of each of the hollow spheres. In such a structure, the number of the contact points is small and the areas of the contact points are small. Therefore, the binding between the hollow spheres is considered to be weak.

EXAMPLE 4

Figure 7:
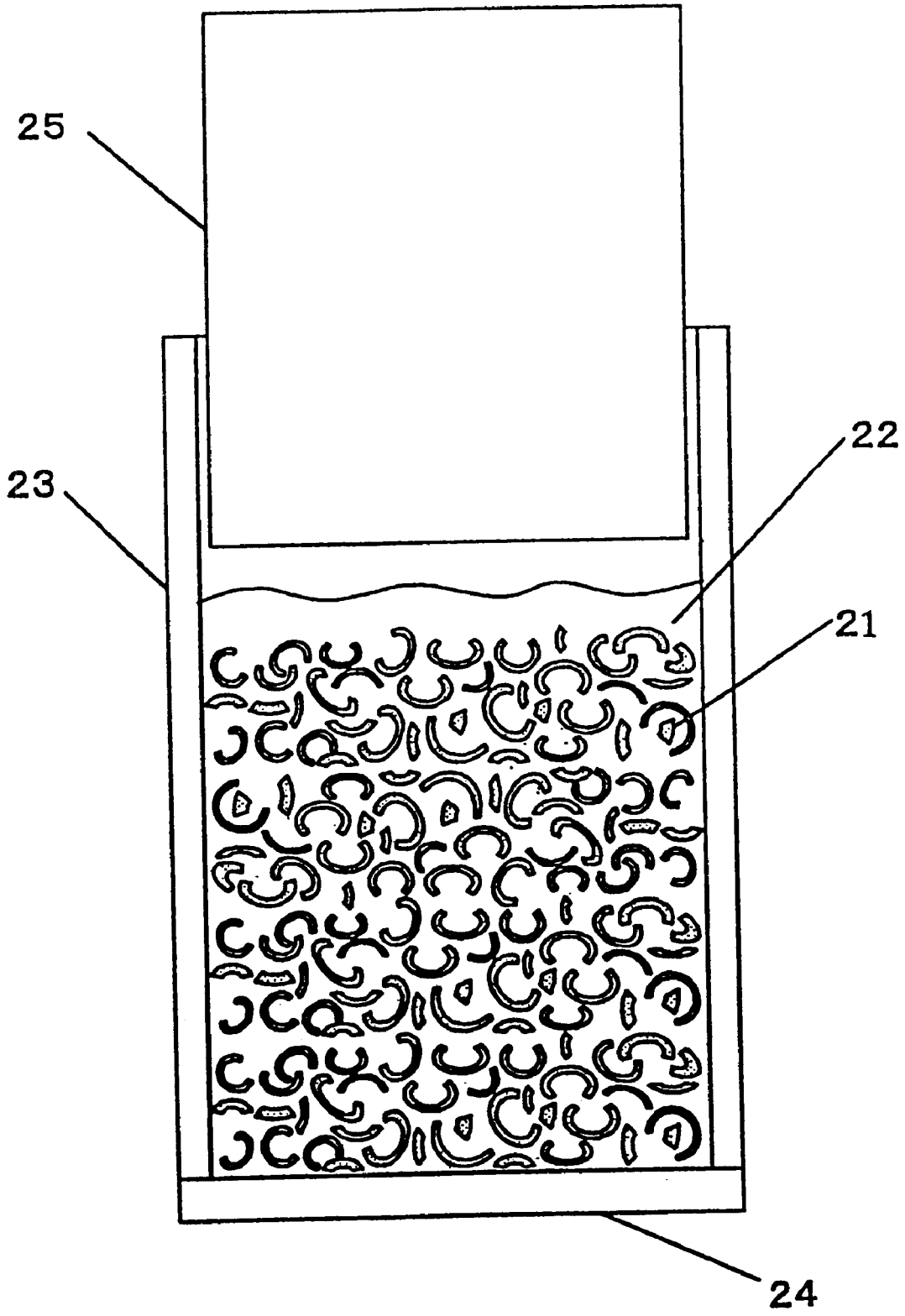
FIG. 7 shows an exemplary structure of a production apparatus according to a fourth example of the present invention.

FIG. 7 shows an exemplary structure of a production apparatus according to a fourth example of the present invention. The production apparatus is used for producing an acoustic matching member described in the first through third examples.

The production apparatus includes a molding case 23 used for mixing a plurality of fine pieces 21 and a liquid 22 and molding the mixture, a bottom lid 24 for opening and closing one of openings of the molding case 23, and a pressurizing rod 25 for pressurizing the mixture of the plurality of fine pieces 21 and the liquid 22.

The molding case 23 is formed of, for example, Teflon. Teflon is slippery and thus allows the molded mixture (molded product) to be removed from the molding case 23 without applying an extra force. Thus, the molded product is prevented from being destroyed.

The bottom lid 24 is provided at one of the openings of the molding case 23. The bottom lid 24 is closed until the molding of the mixture is finished so that the mixture of the fine pieces 21 and the liquid 22 does not leak from the molding case 23. The bottom lid 24 can be, for example, a Teflon plate or a plate-shaped piece of cellophane tape extended over the opening of the molding case 23.

The pressurizing rod 25 is movable along an inner wall of the molding case 23 and is used for pressurizing the mixture of the plurality of fine pieces 21 and the liquid 22. By pressurizing the mixture, the liquid 22 is removed from the mixture. By adjusting the distance by which the mixture is pressurized, the density of the plurality of fine pieces 21 can be set at a desirable density. The pressurizing rod 25 is, for example, stainless steel.

The fine pieces 21 are formed of, for example, glass having a three-dimensional structure. The three-dimensional structure of the fine pieces 21 is not limited to any specific three-dimensional structure. The material for the fine pieces 21, though, needs to be selected so that the bulk density of the fine pieces 21 is lower than the density of the material of the fine pieces 21. As the bulk density of the fine pieces 21 is smaller than the density of the material of the fine pieces 21 by a larger difference, more gaps can be formed in the aggregation of the fine pieces 21. Thus, the density of the acoustic matching member formed of an aggregation of the fine pieces 21 can be reduced.

In the fourth example, the glass fine pieces 21 have a size of 100 $\mu$m or less and a thickness of several micrometers. The glass has a density of 2.2 g/cm$^3$ and allows a sonic speed of about 5000 m/s. However, the fine pieces 21 have a three-dimensional structure, and so the bulk density of the aggregation of the fine pieces 21 is lower than the density of the glass. As the material of the fine pieces 21, ceramic or metal materials are usable.

The liquid 22 is, for example, distilled water. The specific gravity of water is 1 g/cm$^3$. As the liquid 22, a liquid having a higher viscosity than water such as, for example, a mixture of PVA (polyvinyl alcohol) and water can be used. By using a liquid having a higher viscosity than water, the shape of the molded product can be easily maintained even after the molding of the mixture of the fine pieces 21 and the liquid 22 is finished.

Figure 8:
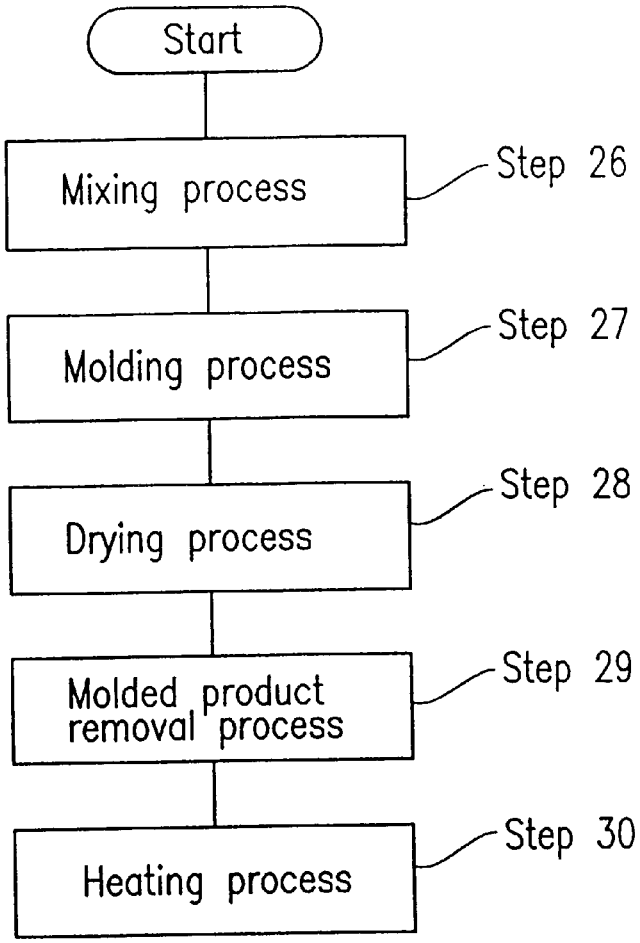
FIG. 8 is a flowchart illustrating a procedure of a method for producing an acoustic matching member using the production apparatus shown in FIG. 7.

FIG. 8 shows a procedure of a method for producing an acoustic matching member using the production apparatus shown in FIG. 7.

In step 26, a mixing process is performed. In the mixing process, for example, the plurality of glass fine pieces 21 and the liquid 22 (for example, distilled water) are fully stirred in a beaker. As a result, a mixture of the plurality of fine pieces 21 and the liquid 22 is produced. By performing the stirring in the beaker fully, the distribution of the plurality of fine pieces 21 in the mixture can be almost uniform. The amount of the liquid 22 can be arbitrarily set. In this example, the amount of the liquid 22 is an amount which allows the mixture to flow into the molding case 23 when the plurality of fine pieces 21 and the liquid 22 are fully mixed.

In step 27, a molding process is performed. In the molding process, the mixture of the plurality of fine pieces 21 and the liquid 22 is placed in the molding case 23 and pressurized by the pressurizing rod 25. As a result, an extra portion of the liquid 22 is pressurized out from the molding case 23. Thus, the density of the aggregation of the fine pieces 21 is adjusted. The adjustment of the density of the aggregation of the fine pieces 21 is performed by setting the total weight and the total volume of the plurality of fine pieces 21 to be placed in the molding case 23.

In step 28, a drying process is performed. In the drying process, the molding case 23 is heated at a temperature at which the liquid 22 is not boiled. Thus, the liquid 22 vaporizes.

In step 29, a molded product removal process is performed. In the molded product removal process, the bottom lid 24 is opened and the aggregation of the plurality of fine pieces 21 is pressurized out by the pressurizing rod 25. Thus, the aggregation of the plurality of fine pieces 21 is removed from the molding case 23.

In step 30, a heating process is performed. In the heating process, the fine pieces 21 are heated up to a temperature at which the fine pieces 21 are softened. Thus, the aggregation of the fine pieces 21 is solidified.

Figure 9:
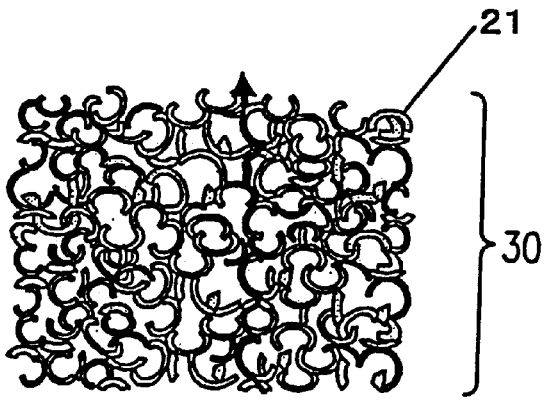
FIG. 9 is a cross-sectional view of an acoustic matching member 30 formed by solidifying an aggregation of fine pieces 21.

FIG. 9 shows a cross-section of an acoustic matching member 30 formed by solidifying the aggregation of the fine pieces 21. In FIG. 9, the path indicated by the arrow is one of sound propagation paths.

As shown in FIG. 9, the length of the sound propagation path in the acoustic matching member 30 is larger than the thickness of the acoustic matching member 30. Thus, the sonic speed allowed by the acoustic matching member 30 can be reduced. Since the fine pieces 21 have a three-dimensional structure, a gap can be formed and a plurality of contact points can also be provided. Therefore, the number of the contact portions is increased and so the contact area is increased. As a result, the binding between the fine pieces 21 can be strengthened. Since the aggregation of the fine pieces 21 can be molded of the mixture obtained by fully stirring the fine pieces 21 and the liquid 22, the distribution of the fine pieces 21 can be uniform. As a result, the density nonuniformity dispersion and the sonic speed nonuniformity of the acoustic matching member 30 can be suppressed.

EXAMPLE 5

A production method according to a fifth example of the present invention will be described. This production method is a variation of the production method described in the fourth example with reference to FIG. 8.

In the molding process shown in step 27 of FIG. 8, the liquid 22 can be caused to vaporize after the plurality of fine pieces 21 are precipitated. The density nonuniformity caused by the load can be reduced by precipitating the plurality of fine pieces 21 using gravity without applying any extra load to the plurality of fine pieces 21.

When the plurality of fine pieces 21 of different weights and different sizes exist, the fine pieces 21 are precipitated in an order from the heaviest fine pieces 21 due to the gravity. Thus, an acoustic matching member including having a plurality of layers having different densities can be produced.

Figure 10:
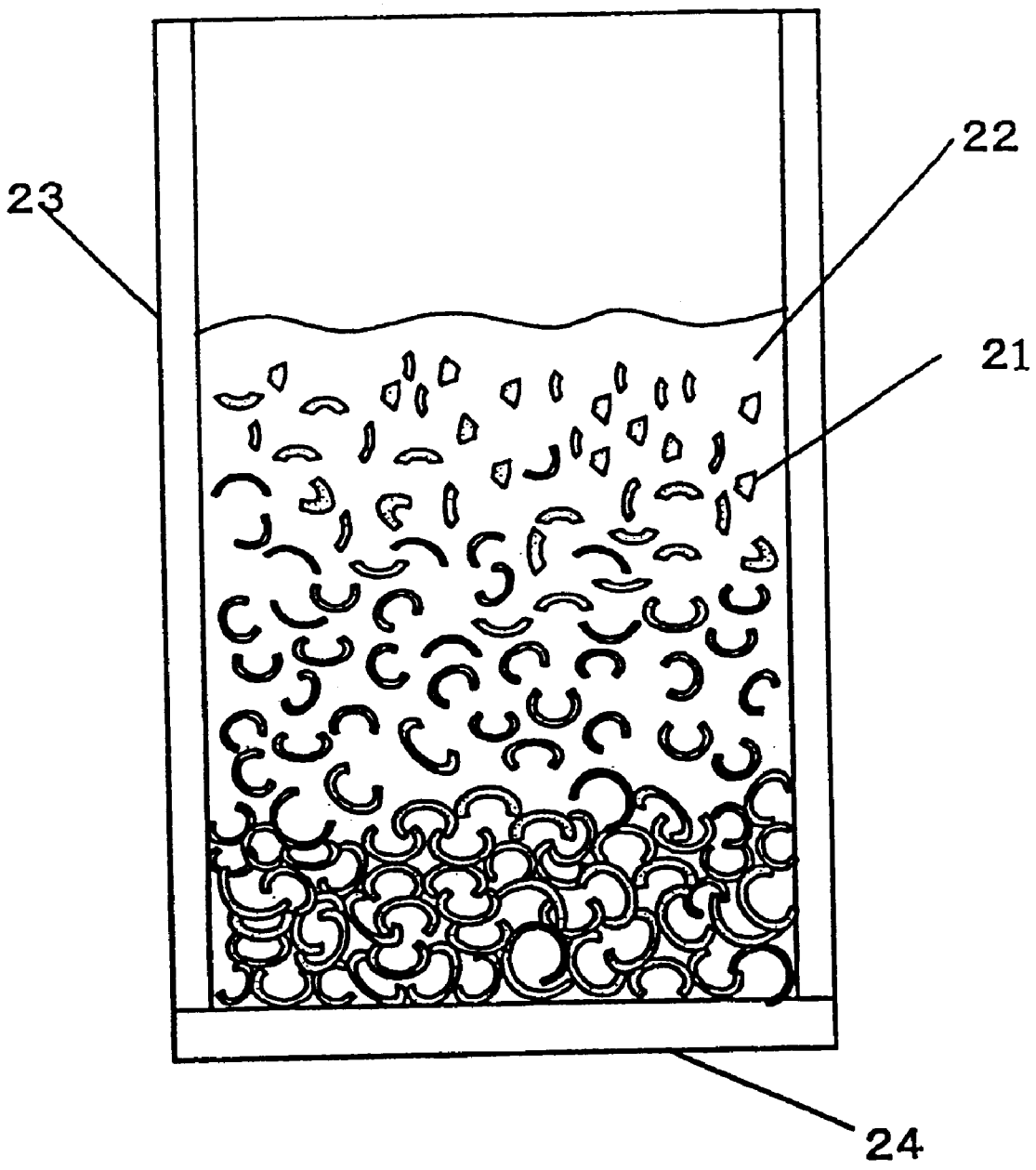
FIG. 10 shows a production method according to a fifth example of the present invention.

FIG. 10 shows a state in which the plurality of fine pieces 21 having different weights and sizes are precipitated. In FIG. 10, identical elements previously discussed with respect to FIG. 7 bear identical reference numerals and the detailed descriptions thereof will be omitted.

The liquid 22 is, for example, distilled water. The amount of the liquid 22 is set to be sufficiently larger than the total volume of the plurality of fine pieces 21 so that the plurality of fine pieces 21 are easily precipitated. The density of the distilled water is 1 g/cm$^3$, which is lower than the density of the glass of 2.2 g/cm$^3$. Accordingly, when the glass fine pieces 21 are put into the distilled water, the glass fine pieces 21 are precipitated.

EXAMPLE 6

Figure 11:
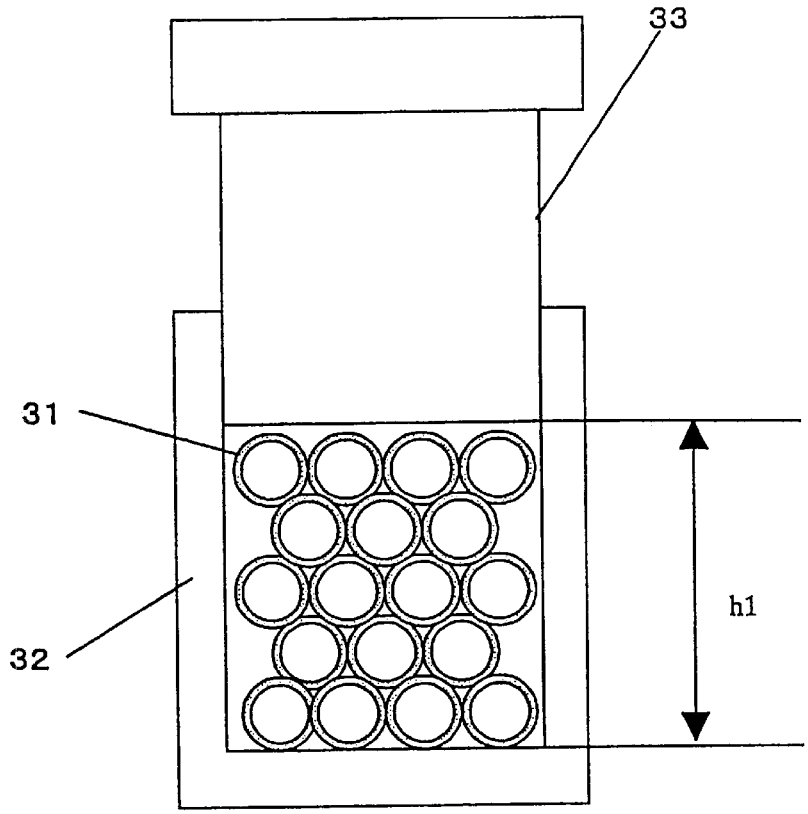
FIG. 11 shows a method for forming a plurality of fine pieces according to a sixth example of the present invention.
Figure 12:
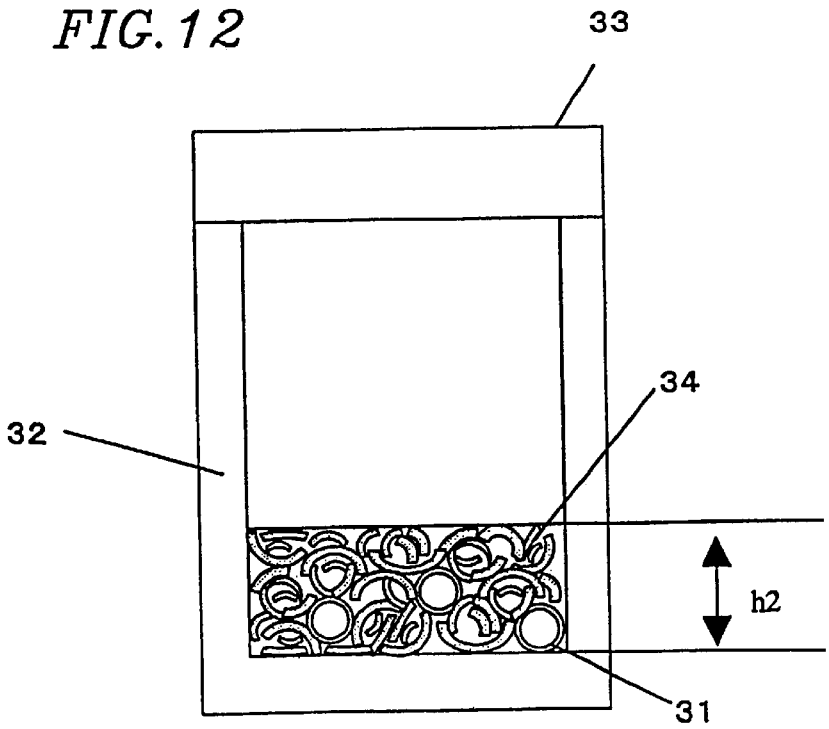
FIG. 12 shows a method for forming a plurality of fine pieces according to the sixth example of the present invention.

With reference to FIGS. 11 and 12, a method for producing a plurality of fine pieces according to a sixth example of the present invention will be described.

A metal case 32 and a pressurizing rod 33 are formed of, for example, stainless steel. However, the metal case 32 and the pressurizing rod 33 are not limited to such a material.

The pressurizing rod 33 is movable along an inner wall of the metal case 32, and is used for pressurizing and thus pulverizing fine hollow spheres 31.

FIG. 11 shows a state where the plurality of fine hollow spheres 31 are accommodated in the metal case 32 (a state where the pressurizing rod 33 is not pushed). In FIG. 11, hi shows a height of an aggregation of the fine hollow spheres 31 in the state where the pressurizing rod 33 is not pushed.

The fine hollow spheres 31 are, for example, glass balloons ("Scotchlight™ Glass Bubbles Filler" available from Sumitomo 3M Ltd.). The glass balloons have a true density of 0.13 g/cm$^3$, a diameter of about 100 $\mu$m, and a thickness of several micrometers.

FIG. 12 shows a state where the pressurizing rod 33 is pushed from the state shown in FIG. 11 down to a height h2. The pressurizing rod 33 is operated using, for example, a hydraulic press.

The fine hollow spheres 31 pressurized by the pressurizing rod 33 are compressed and pulverized. Fragments (fine pieces) of the pulverized fine hollow spheres 31 are a part of the spheres. Thus, fine pieces 34 having a three-dimensional structure can be obtained.

A step of forming the plurality of fine pieces 34 by pulverizing the fine hollow spheres 31 can be inserted, for example, before step 26 (mixing process) of the production method for producing the acoustic matching member shown in FIG. 8.

All the fine hollow spheres 31 accommodated in the metal case 32 are not pulverized. When there are hollow spheres 31 which have not been pulverized, it is preferable to distinguish the unpulverized hollow spheres 31 from the fine pieces 34 and re-use the unpulverized hollow spheres 31.

Figure 13:
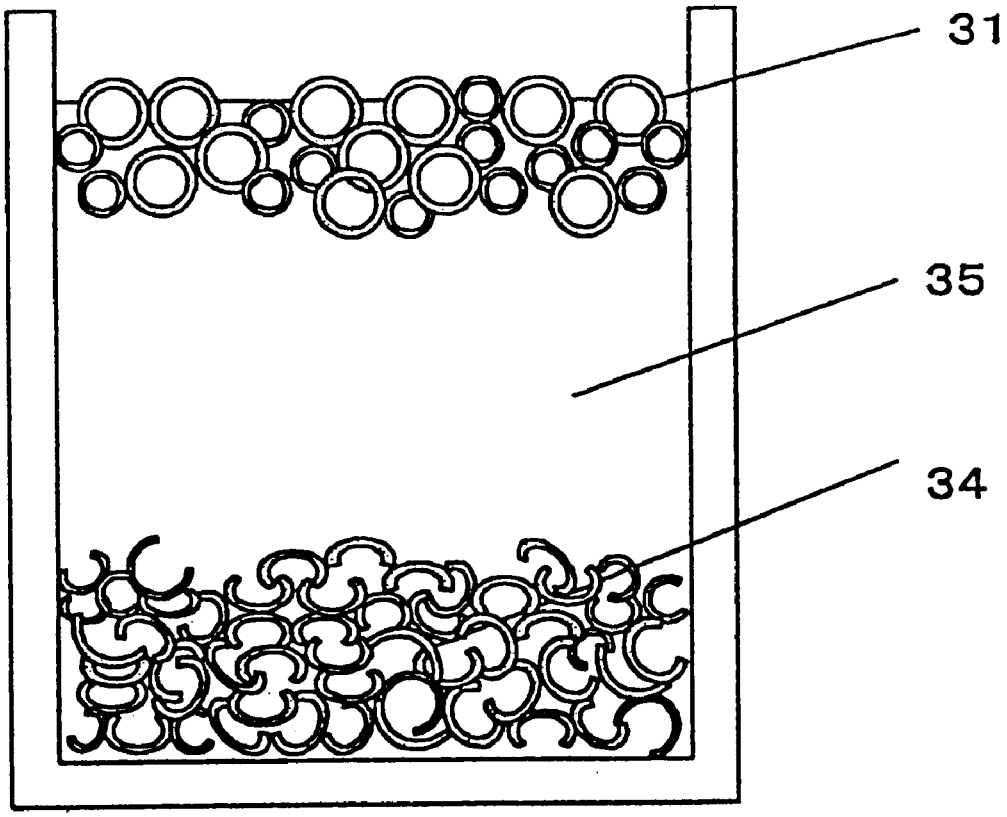
FIG. 13 shows a method for distinguishing unpulverized fine hollow spheres 31 from fine pieces 34.

FIG. 13 shows an example of a method for distinguishing the unpulverized hollow spheres 31 from the fine pieces 34.

A liquid 35 is distilled water. The density of the distilled water (1 g/cm$^3$) is between the density of the hollow spheres 31 (0.13 g/cm$^3$) and the density of the fine pieces 34 (2.2 g/cm$^3$). Accordingly, the hollow spheres 31, which have a lower density than that of the liquid 35, float. The fine pieces 34, which have a higher density than that of the liquid 35, is precipitated. Thus, the unpulverized hollow spheres 31 can be distinguished from the fine pieces 34, utilizing the difference in density.

Figure 14A:
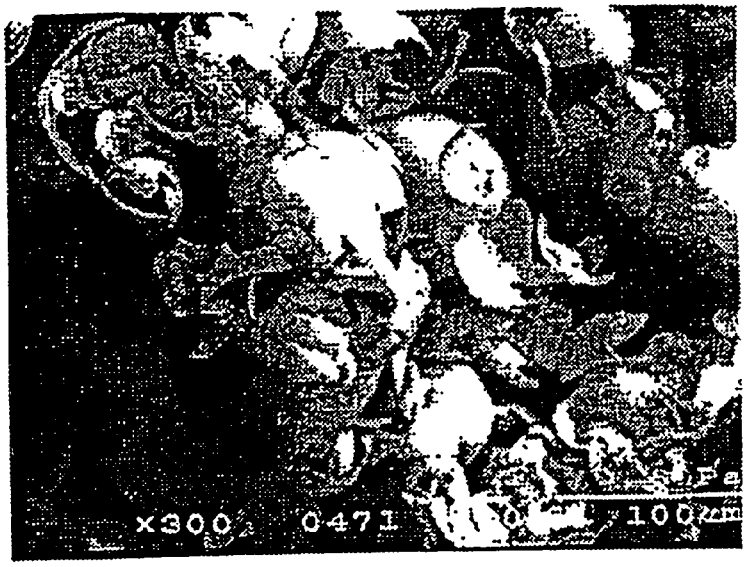
FIG. 14A shows a shape of the fine pieces 34 obtained when h2/h1=0.5.
Figure 14B:
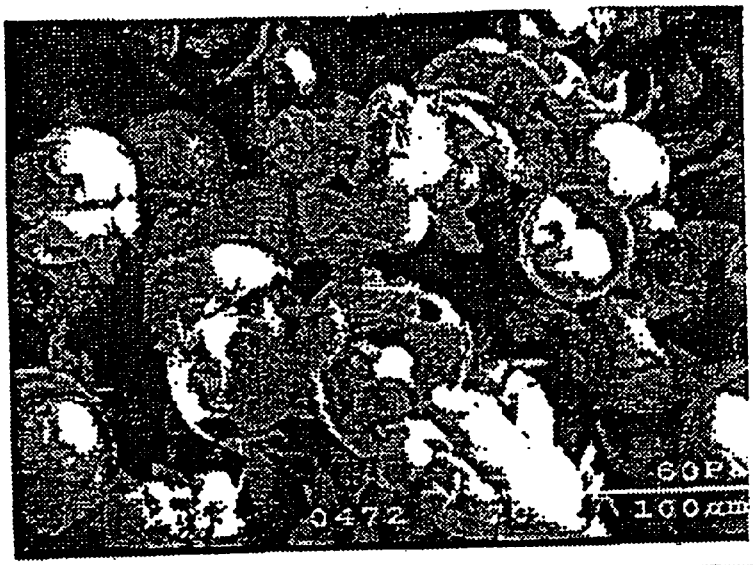
FIG. 14B shows a shape of the fine pieces 34 obtained when h2/h1=0.33.
Figure 14C:
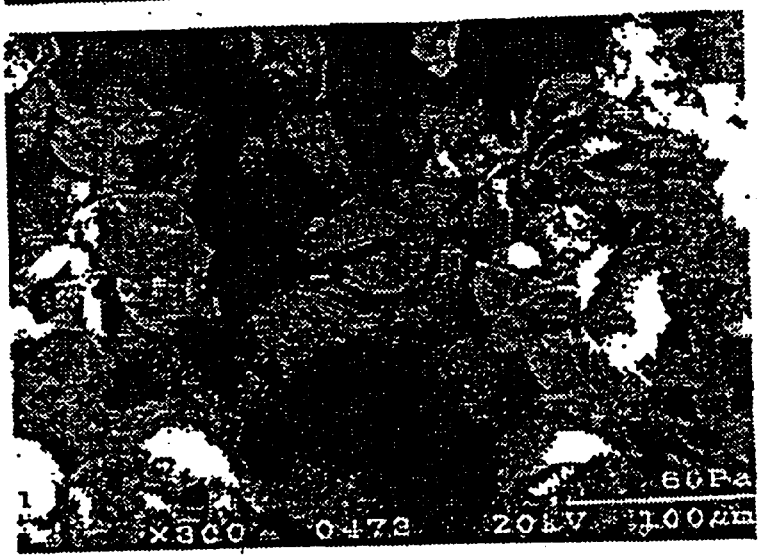
FIG. 14C shows a shape of the fine pieces 34 obtained when h2/h1=0.2.

FIG. 14A shows a shape of the fine pieces 34 obtained when h2/h1=0.5. FIG. 14B shows a shape of the fine pieces 34 obtained when h2/h1=0.33. FIG. 14C shows a shape of the fine pieces 34 obtained when h2/h1=0.2.

Here, h2/h1 (i.e., the ratio between the volume of the plurality of fine hollow spheres 31 before being pulverized and the volume of the plurality of fine pieces 34 obtained by pulverizing the plurality of fine hollow spheres 31) indicates the degree of the pulverization of the plurality of hollow spheres 31.

As shown in FIGS. 14A through 14C, the size of the fine pieces 34 can be controlled by controlling the degree of the pulverization of the plurality of hollow spheres 31.

Figure 15:
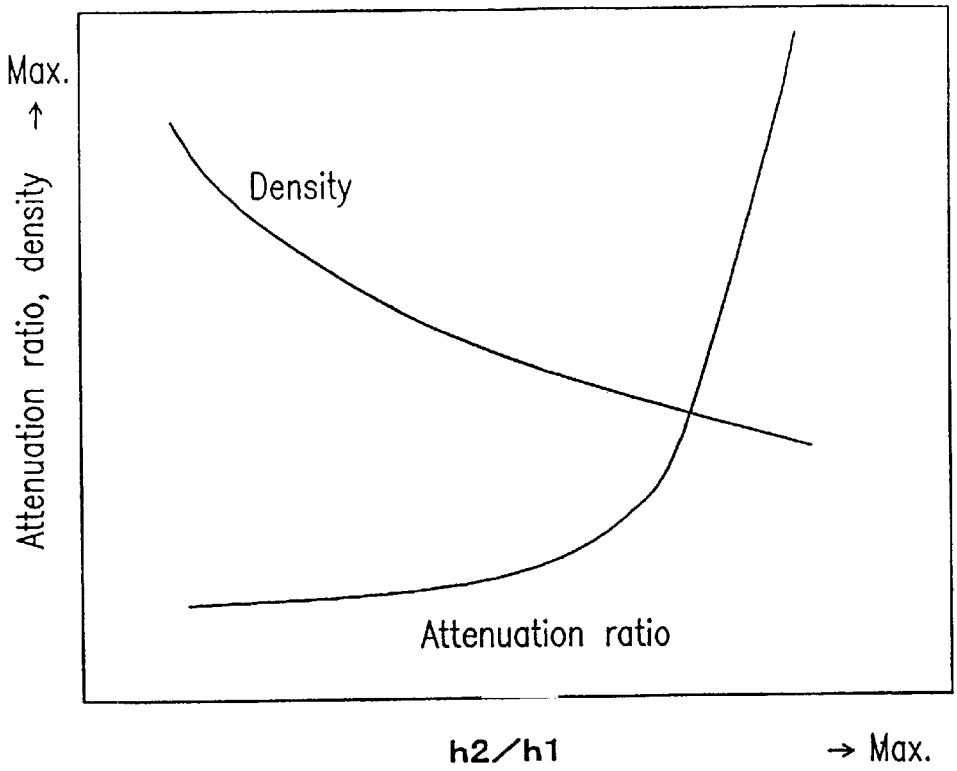
FIG. 15 shows the relationship between h2/h1 and the density of the acoustic matching member, and the relationship between h2/h1 and the attenuation ratio of the sound.

FIG. 15 shows the relationship between h2/h1 and the density of the acoustic matching member, and the relationship between h2/h1 and the attenuation ratio of the sound. Here, it is assumed that the acoustic matching member is formed of the plurality of fine pieces 34. As the attenuation ratio of the sound is larger, the output of the sound is smaller.

As shown in FIG. 15, as h2/h1 is smaller, the density of the acoustic matching member is higher and the attenuation ratio of the sound is lower.

The reason why the density of the acoustic matching member is higher as h2/h1 is smaller is considered to be as follows: as h2/h1 is smaller, the size of the fine pieces 34 is smaller and thus the fine pieces 34 more easily enter even a small gap. The reason why the attenuation ratio of the sound is lower as h2/h1 is smaller is considered to be as follows: since the fine pieces 34 exist with no gap therebetween, the contact area between the fine pieces 34 becomes larger and thus the binding between the fine pieces 34 is strengthened.

Thus, the density of the acoustic matching member and the attenuation ratio of the sound can be controlled by controlling h2/h1.

The characteristic of the acoustic matching member shown in FIG. 15 is one example. The characteristic of the acoustic matching member according to the present invention is not limited to this.

Figure 16:
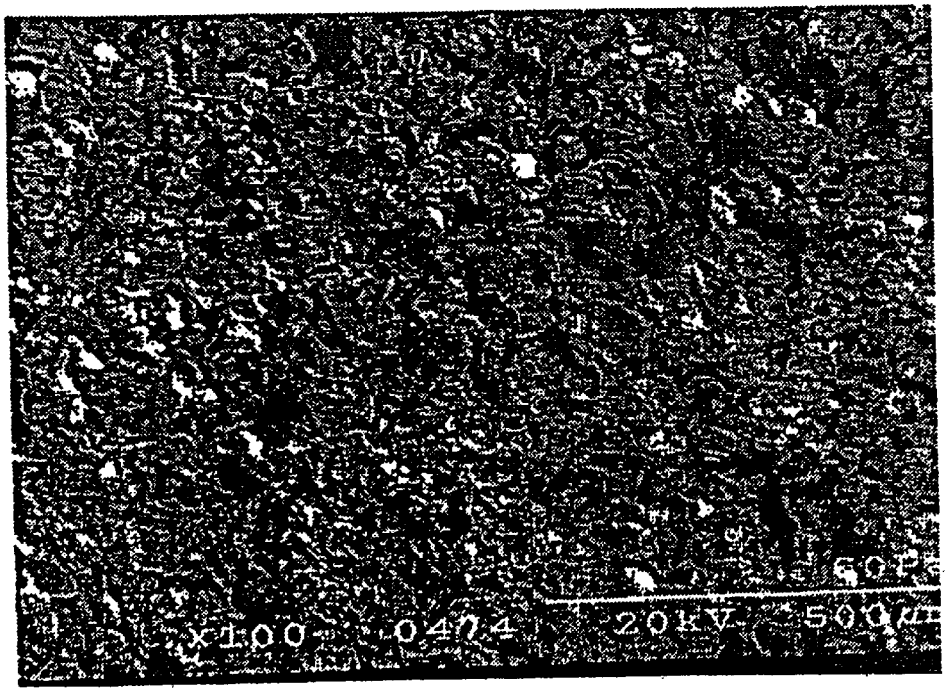
FIG. 16 shows a cross-section of an acoustic matching member formed using the plurality of fine pieces 34 obtained when h2/h1=0.33.

FIG. 16 shows a cross-section of an acoustic matching member formed of the plurality of fine pieces 34 obtained when h2/h1=0.33.

A production method of the acoustic matching member shown in FIG. 16 is similar to the production method shown in FIG. 8. This acoustic matching member has a density of 0.55 g/cm$^3$, allows a sonic speed of 1400 m/s, and has an acoustic impedance of $0.77\times10^6$ kg/m$^2$s. This acoustic matching member has a larger acoustic impedance but a smaller attenuation ratio of sound than the conventional acoustic matching member formed only of glass balloons described in Japanese Laid-Open Publication No. 2-177799, and therefore, can output a louder sound.

EXAMPLE 7

Figure 17:
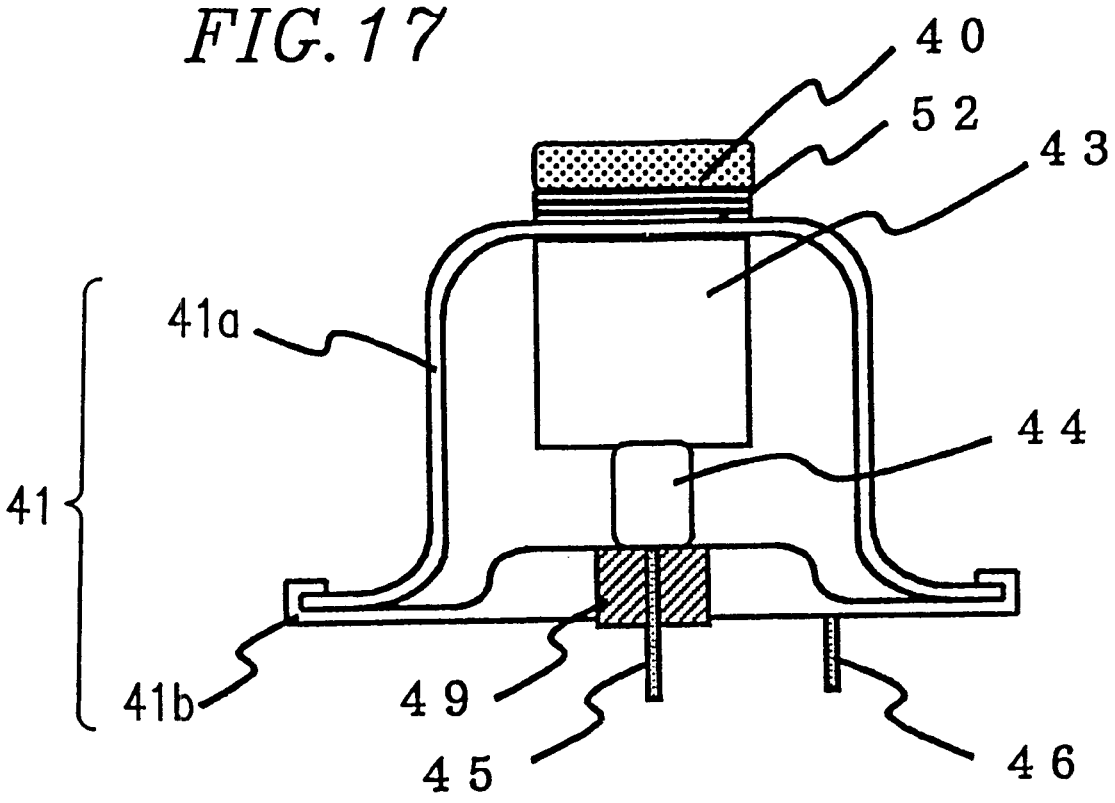
FIG. 17 shows an exemplary structure of an ultrasonic transmitting and receiving device according to a seventh example of the present invention.

FIG. 17 shows an exemplary structure of an ultrasonic transmitting and receiving device according to a seventh example of the present invention. The ultrasonic transmitting and receiving device is used for a flow rate measurement device for measuring a flow rate of a fluid, or a distance measurement device for measuring a distance between an object and the distance measurement device, both using an ultrasonic wave.

The ultrasonic transmitting and receiving device includes a vibrator 43, a metal case 41 for accommodating the vibrator 43, an acoustic matching member 40 used for matching,an acoustic impedance of the vibrator 43 and an acoustic impedance of a fluid flowing outside the metal case 41, and a bonding member 52 for bonding the acoustic matching member 40 and the metal case 41.

The metal case 41 includes a main body 41*a* and a lid 41*b* welded to the main body 41*a*.

An electrode 45 is electrically connected to the vibrator 43 via a conductive rubber member 44. A glass member 49 is sealed between the electrode 45 and the metal case 41. The electrode 45 is electrically insulated from the lid 41*b* of the metal case 41 by the glass member 49.

An electrode 46 is electrically connected to the lid 41*b* of the metal case 41. The electrode 46 is grounded.

The electrodes 45 and 46 are supplied with an AC voltage of about 5 V. The voltage applied to the electrodes 45 and 46 is applied to the vibrator 43. By applying an AC voltage of 500 kHz to the electrodes 45 and 46, the vibrator 43 vibrates at 500 kHz. The vibration of the vibrator 43 is propagated to the main body 41*a* of the metal case 41, thereby vibrating the main body 41*a* of the metal case 41.

The vibration of the main body 41*a* of the metal case 41 is propagated to the acoustic matching member 40 via the bonding member 52, thereby vibrating the acoustic matching member 40.

A role of the acoustic matching member 40 is to efficiently propagate the vibration of the vibrator 43 to a fluid (for example, a gas) flowing outside the metal case 41.

The conductive rubber member 44 also plays a role of a buffer to vibration for preventing the vibration of the vibrator 43 from propagating to the lid 41*b* of the metal case 41 so as to efficiently propagate an energy of the vibration of the vibrator 43 to the acoustic matching member 40.

The vibrator 43 and the conductive rubber member 44 are accommodated inside the metal case 41. By using the metal case 41 and also by sealing the glass member 49 between the electrode 45 and the lid 41*b* of the metal case 41, permeation of the fluid (for example, a gas) to the inside of the metal case 41 can be inhibited with certainty. As a result, deterioration of the vibrator 43 by the fluid (for example, a gas) can be prevented.

As the acoustic matching member 40, the acoustic matching members described in the first through third example or the acoustic matching members produced by the product ion methods described in the fourth through sixth examples are usable.

The metal case 41 is formed of, for example, stainless steel. The acoustic matching member 40 is, for example, an aggregation of glass fine pieces. When the thermal expansion ratio of the metal case 41 is significantly different from the thermal expansion ratio of the acoustic matching member 40 as in this case, direct bonding of the metal case 41 and the acoustic matching member 40 with solder results in the acoustic matching member 40 easily coming off from the metal case 41 due to the stress applied to the bonding portion.

The bonding member 52 is provided between the metal case 41 and the acoustic matching member 40 so as to reduce the difference between the thermal expansion ratio of the metal case 41 and the thermal expansion ratio of the acoustic matching member 40. The bonding member 52 prevents the acoustic matching member 40 from coming off from the metal case 41.

Figure 18:
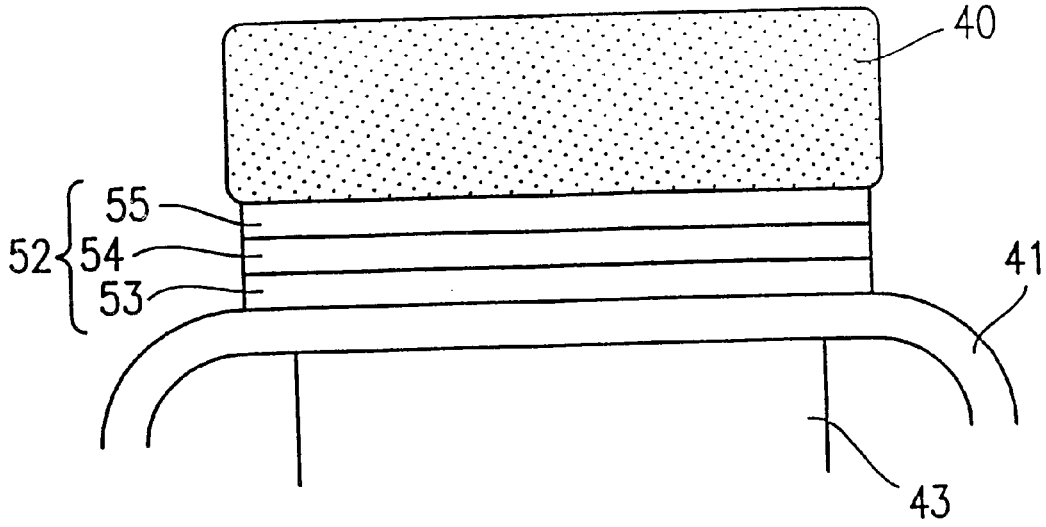
FIG. 18 shows an exemplary structure of a bonding member 52.

FIG. 18 shows an exemplary structure of the bonding member 52.

The bonding member 52 includes a silver solder foil (a first layer) 53 formed on the metal case 41, a titanium foil (a second layer) 54 formed on the silver solder foil 53, and a silver solder foil (a third layer) 55 formed on the titanium foil 54. The acoustic matching member 40 is formed on the silver solder foil (a third layer) 55.

The thermal expansion ratio at 20° C. is 14.7 K$^{-1}$ for stainless steel, 8.6 K$^{-1}$ for titanium, and 0.55 to 8 K$^{-1}$ for glass. By causing titanium, having an intermediate thermal expansion ratio between those of stainless steel and glass, to be placed between the glass member and the stainless steel member, the stress applied on the bonding face can be reduced. The stainless steel member and the titanium foil are bonded together via the silver solder, and the titanium foil is bound with oxygen contained in glass. Thus, the metal case 41 and the acoustic matching member 40 are bonded together.

The acoustic matching member 40, which is formed as an aggregation of glass fine pieces, do not have a high mechanical strength. In order to prevent the stress generated by the difference in thermal expansion ratio between stainless steel and glass from being applied on the acoustic matching member 40, a bonding member 52 shown in FIG. 19 can be used instead of the bonding member 52 shown in FIG. 18.

Figure 19:
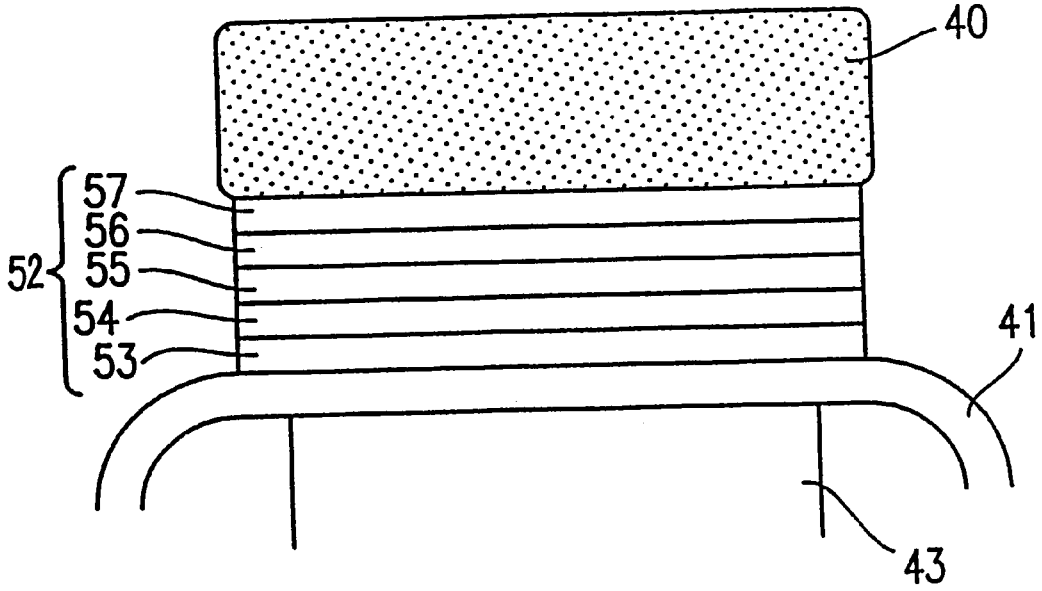
FIG. 19 shows another exemplary structure of a bonding member 52.

FIG. 19 shows another exemplary structure of the bonding member 52.

The bonding member 52 shown in FIG. 19 includes, in addition to the silver solder foil (the first layer) 53, the titanium foil (the second layer) 54 and the silver solder foil (the third layer) 55 included in the bonding member 52 shown in FIG. 18, a ceramic or high melting point glass plate (a fourth layer) 56 formed on the silver solder foil 55 and a low melting point glass plate (a fifth layer) 57 formed on the ceramic or high melting point glass plate 56. The acoustic matching member 40 is formed on the low melting point glass plate 57.

As the low melting point glass of the fifth layer 57, a glass material having a lower melting point than that of the glass of the acoustic matching member 40 is used. As the glass of the fourth layer 56, a glass material having a higher melting point than that of the low melting point glass of the fifth layer 57 is used.

By forming the fourth layer 56 to be a plate, the mechanical strength of the fourth layer 56 can be higher than that of the acoustic matching member 40. Since the thermal expansion ratio of the fourth layer 56 and that of the acoustic matching member 40 are substantially equal to each other, almost no stress is applied on the acoustic matching member 40.

Figure 20:
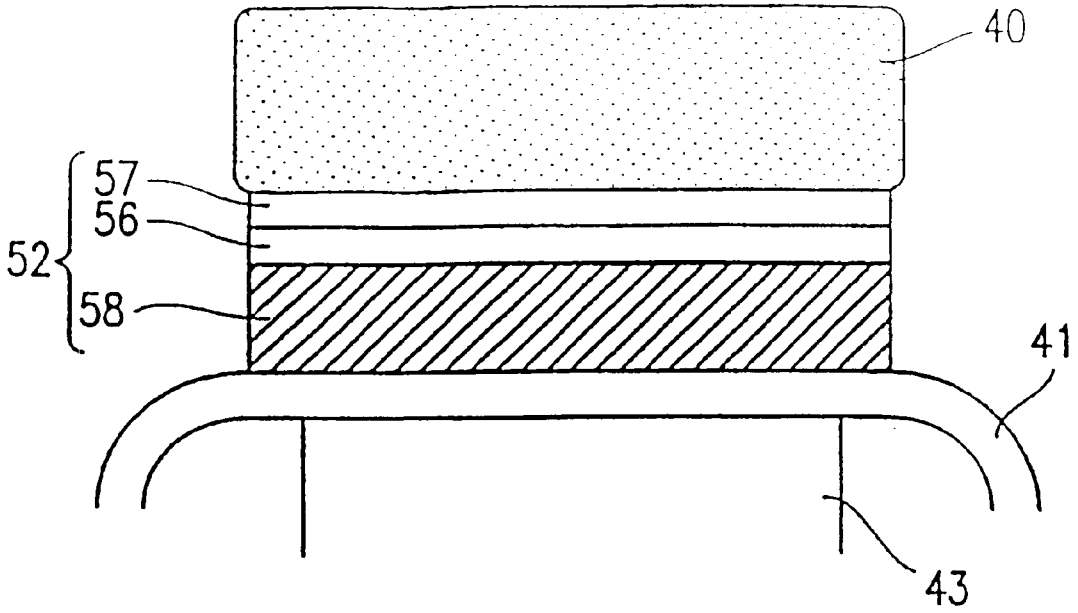
FIG. 20 shows still another exemplary structure of a bonding member 52.

FIG. 20 shows still another exemplary structure of the bonding member 52.

The bonding member 52 shown in FIG. 20 includes a powder paste layer (a first layer) 58 formed on the metal case 41, a ceramic or high melting point glass plate (a second layer) 56 formed on the powder paste layer 58 and a low melting point glass plate (a third layer) 57 formed on the ceramic or high melting point glass plate 56. The acoustic matching member 40 is formed on the low melting point glass plate 57.

The second layer 56 and the third layer 57 shown in FIG. 20 are identical with the fourth layer 56 and the fifth layer 57 shown in FIG. 19.

The powder paste layer 58 (the first layer) is formed by mixing silver solder powder and titanium powder into a paste and then applying the paste on the metal case 41.

The ceramic or high melting point glass plate (the second layer) 56 is placed on the powder paste layer 58, and the layers are heated to be bonded together. Then, the low melting point glass plate (the third layer) 57 is formed on the ceramic or high melting point glass plate (the second layer) 56. After that, the bonding member 52 is heated. Thus, the metal case 41 and the acoustic matching member 40 are bonded tog ether.

By adjusting the amount of the silver solder powder and the amount of the titanium solder powder, the bonding strength can be adjusted to a certain degree. For example, when the weight ratio between titanium and silver solder is 1:30, the bonding strength can be reduced from that of the structure shown in FIG. 18 which uses the titanium foil 54. Thus, the stress generated by the difference in thermal expansion ratio can be reduced. As a result, the distortion of the stainless steel generated in the metal case 41 can be reduced. Therefore, the gap between the vibrator 43 and the metal case 41 can be reduced, and thus the vibration of the vibrator 43 can be efficiently transferred to the metal case 41.

Figure 21:
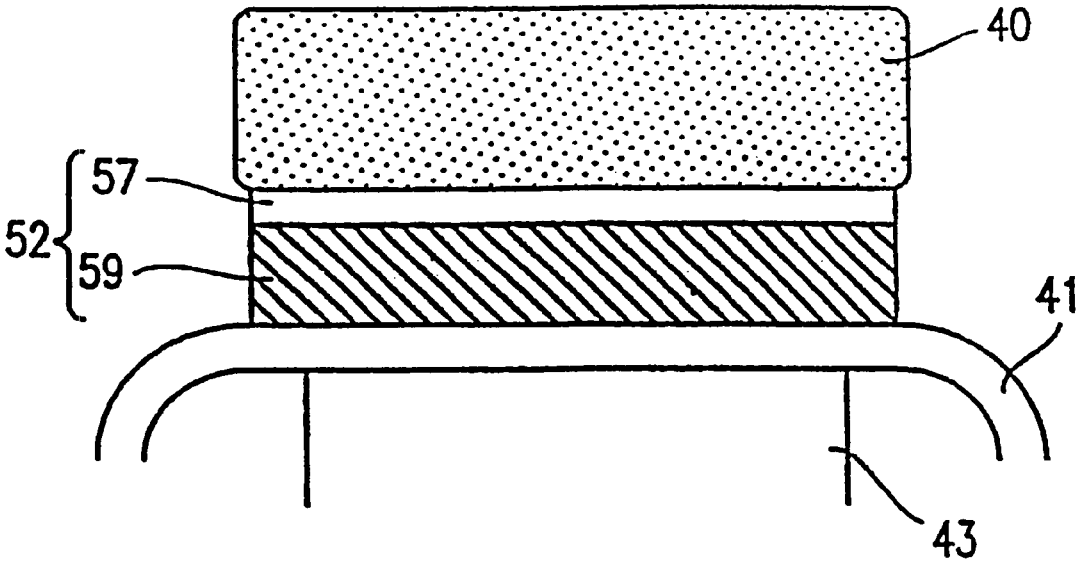
FIG. 21 shows still another exemplary structure of a bonding member 52.

FIG. 21 shows still another exemplary structure of the bonding member 52.

The bonding member 52 shown in FIG. 21 includes a base layer (a first layer) 59 formed on the metal case 41 and a low melting point glass plate (a second layer) 57 formed on the base layer 59. The acoustic matching member 40 is formed on the low melting point glass plate (the second layer) 57.

The second layer 57 shown in FIG. 21 is identical with the fifth layer 57 shown in FIG. 19.

The base layer 59 (the first layer) is formed by mixing silver solder powder, titanium powder and ceramic powder into a paste, next applying the paste on the metal case 41, and then baking the paste.

The low melting point glass plate (the second layer) 57 is placed on the base layer 59, and then the bonding member 52 is heated. Thus, the metal case 41 and the acoustic matching member 40 are bonded together.

When the ceramic powder and the silver solder powder are mixed and baked, the ceramic powder is covered with the silver solder powder. However, a ceramic portion can be exposed on a surface of the base layer 59 by polishing the surface of the base layer 59. The ceramic portion and the glass of the second layer 57 are bound to each other by heating, and the glass of the second layer 57 and the acoustic matching member 40 are also bound to each other by heating. Thus, the metal case 41 and the acoustic matching member 40 are bonded together.

EXAMPLE 8

Figure 22:
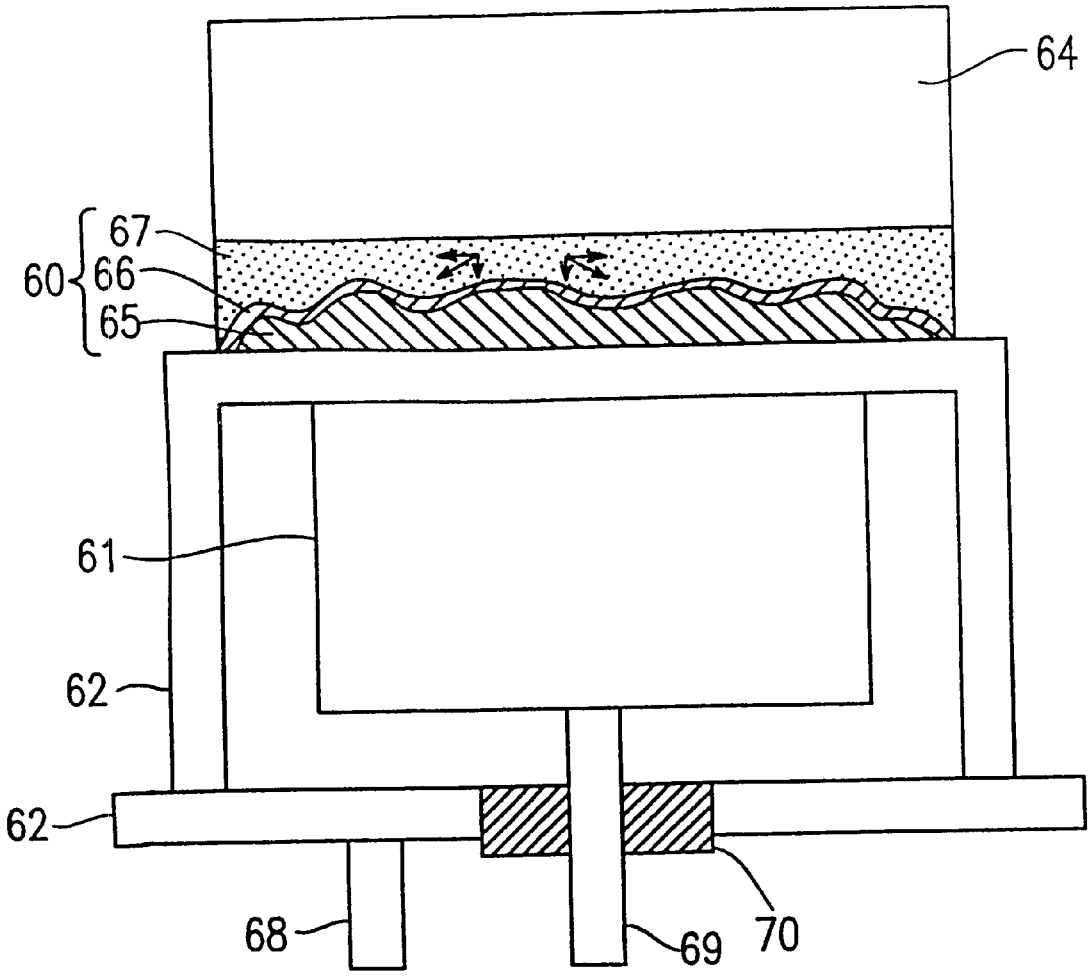
FIG. 22 shows an exemplary structure of an ultrasonic transmitting and receiving device according to an eighth example of the present invention.

FIG. 22 show an exemplary structure of an ultrasonic transmitting and receiving device according to an eighth example of the present invention.

The ultrasonic transmitting and receiving device includes a vibrator 61, a metal case 62 for accommodating the vibrator 61, an acoustic matching member 64 used for matching an acoustic impedance of the vibrator 61 and an acoustic impedance of a fluid flowing outside the metal case 62, and a bonding member 60 for bonding the acoustic matching member 64 and the metal case 62.

The vibrator 61 is, for example, a piezoelectric vibrator formed of a ceramic material.

The metal case 62 is preferably formed of a material having a satisfactory resistance against corrosion and a high strength. The metal case 62 is formed of, for example, stainless steel.

The metal case 62 has a thickness of 200 to 300 $\mu$m. The thickness of the metal case 62 is made thin for the following reasons. First, when considering the transmission of the sound from the vibrator 61 to the acoustic matching member 64, an acoustic impedance of the metal case 62 can be ignored. Second, the attenuation of sound energy when the sound is propagated through the metal case 62 can be reduced. When the thickness of the metal case 62 is excessively small, however, the strength of the stainless steel used as a material of the metal case 62 is decreased. The thickness of the metal case 62 is made as small as possible but sufficient to maintain a satisfactory strength of the stainless steel.

The metal case 62 accommodates the vibrator 61 therein in a sealed state as in the seventh example. Thus, a gas or water is prevented from permeating into the vibrator 61, and thus deterioration or malfunction of the vibrator 61 can be prevented.

The acoustic matching member 64 is, for example, formed as an aggregation of glass fine pieces having a three-dimensional structure shown in FIG. 3. The acoustic matching member 64 can have a structure having a number of gaps. Here, the acoustic matching member 64 has a density of 0.4 to 0.6 g/cm$^3$ and allows a sonic speed of 1000 to 1300 m/s. The acoustic matching member 64 has a thickness which is about ¼ of the wavelength of the sound. The wavelength $\lambda$ of the sound can be obtained by expression (2).

In the eighth example, a sound of 500 kHz is propagated. Therefore, the wavelength of the sound is 2 to 2.6 mm, and ¼ of the wavelength of the sound is 0.5 to 0.65 mm.

The bonding member 60 includes a first layer 65 formed on the metal case 62, a second layer 66 formed on the first layer, and a third layer 67 formed on the second layer 66. The acoustic matching member 64 is formed on the third layer 67.

The first layer 65 is formed of silver solder. One face of the first layer 65 is bonded to the metal case 62, and the other face of the first layer 65 has a convexed and concaved shape. Hereinafter, the face having the convexed and concaved shape will be referred to as a "convexed and concaved face". The first layer 65 has a thickness of 20 to 50 $\mu$m.

The second layer 66 is formed of titanium oxide. The second layer 66 is formed along the convexed and concaved face of the first layer 65. The second layer 66 has a thickness of several micrometers.

The third layer 67 is formed of glass having a melting point which is lower than that of the material used for the acoustic matching member 64. One face of the third layer 67 is bonded to the second layer 66, and the other face of the third layer 67 is bonded to the acoustic matching member 64. The third layer 67 has a thickness of 50 to 100 $\mu$m.

Electrodes 68 and 69 are used for applying a voltage to the vibrator 61 and removing an output signal from the vibrator 61. An insulating member 70 electrically insulates the electrode 69 from the metal case 62. The insulating member 70 is formed of an insulating material such as, for example, glass or a resin.

Hereinafter, the operation and function of the ultrasonic transmitting and receiving device shown in FIG. 22 will be described.

When an AC voltage of about 500 kHz is applied to the electrodes 68 and 69, the vibrator 61 vibrates at about 500 kHz.

The vibration of the vibrator 61 is propagated to the acoustic matching member 64 via the metal case 62 and the bonding member 60 (the first layer 65, the second layer 66 and the third layer 67).

The metal case 62 has a thickness of 200 to 300 $\mu$m, and the bonding member 60 has a thickness of about 100 $\mu$m. The thickness of the metal case 62 and the thickness of the bonding member 60 are sufficiently shorter than the wavelength of the sound to be propagated. Accordingly, the influence of the acoustic impedances of the metal case 62 and the bonding member 60 can be ignored. As a result, the vibrator 61 can be considered to be in a state similar to that of being adjacent to the acoustic matching member 64.

By reducing the thick ness of the metal case 62 and the thickness of the bonding member 60, the attenuation of sound energy can be reduced.

The vibration of the vibrator 61 is propagated to air via the acoustic matching member 64. The vibrator 61 has an acoustic impedance of about $30\times10^6$ kg/m$^2$s and the acoustic matching member 64 has an acoustic impedance of about $0.6\times10^6$ kg/m$^2$s. The air has an acoustic impedance of about 428 kg/m$^2$s. Accordingly, the sound transmission ratio of the vibrator 61 to the air is about 0.16.

The ultrasonic transmitting and receiving device can transfer the vibration of the air to the vibrator 61 via the acoustic matching member 64, in which case the vibrator 61 converts the vibration into an electric signal and outputs the electric signal to the electrodes 68 and 69.

Thus, the ultrasonic transmitting and receiving device converts an electric signal into a mechanical vibration by the vibrator 61 and transfers the vibration to the air or the like, or converts the vibration of the air into an electric signal by the vibrator 61 and receives the electric signal by the electrodes 68 and 69.

Hereinafter, the function of the ultrasonic transmitting and receiving device shown in FIG. 22 when an ambient temperature thereof is changed will be described. When the ambient temperature of the ultrasonic transmitting and receiving device is changed, the components of the ultrasonic transmitting and receiving device shown in FIG. 22 have the shape including the thickness thereof changed based on the thermal expansion ratio of the materials of the components. However, the thermal expansion ratio at 20° C. is $14.7\times10^{-6}$ k$^{-1}$ for stainless steel, 15 to $16\times10^{-6}$ k$^{-1}$ for silver solder, $8.6\times10^{-6}$ k$^{-1}$ for titanium, and 0.55 to $8\times10^{-6}$ k$^{-1}$ for glass. The components formed of these materials have their shapes changed much less than components formed of resin materials. Especially when the acoustic matching member 64 is formed of glass, the change of the shape in accordance with the temperature is small. Since the thickness of the acoustic matching member 64 can be maintained at ¼ of the wavelength of the sound, the change of the output characteristic in accordance with the temperature can be restricted to be small. The melting point of each of the materials is 400° C. or higher, and therefore the components are not softened unless put under a very high temperature. Thus, the stable quality of the ultrasonic transmitting and receiving device is guaranteed.

The thermal expansion ratio of stainless steel is significantly different from the thermal expansion ratio of glass. Therefore, direct bonding of the metal case 62 formed of stainless steel and the acoustic matching member 64 formed of glass results in an excessive stress. Especially when the metal case 62 is as thin as 200 to 300 $\mu$m, the bonding face may be flexed or the acoustic matching member 64 may be destroyed.

According to the present invention, in order to prevent such an inconvenience from occurring, the second layer 66 formed of a titanium material, having an intermediate thermal expansion ratio between stainless steel and glass, is provided between the glass member and the stainless steel member. Thus, the stress applied on the bonding face is reduced. In addition, the bonding face between the first layer 65 and the second layer 66 is formed to be a convexed and concaved face, so as to diversify the direction of the stress applied on the bonding face. Thus, the stress applied on the second layer 66 and the third layer 67 is reduced.

The thermal expansion ratio of stainless steel is about the same as that of the first layer 65 (silver solder). Therefore, the stainless steel member and the first layer 65 (silver solder) tend to contract in a horizontal direction by the same degree. At this point, a stress is generated at a border between the second layer 66 (titanium), having a lower thermal expansion ratio than the stainless steel member and the first layer 65, and the first layer 65 (silver solder). Concurrently, a stress is generated at a border between the third layer 67 (low melting point glass), having a lower thermal expansion ratio than the second layer 66 (titanium), and the second layer 66 (titanium).

Direction s of the stress generated at the border between the third layer 67 (low melting point glass) and the second layer 66 (titanium) are indicated by thick arrows in FIG. 22. Vectors of stress can be divided into vectors of force in the upward and downward directions and vectors of force in the leftward and rightward directions, as indicated by thin arrows in FIG. 22. The vectors in the upward and downward directions counteract each other, and the vectors in the leftward and rightward directions counteract each other. As a result, the overall stress is reduced.

As described above, the metal case 62 and the acoustic matching member 64 are bonded together with the bonding member 60 for reducing the difference between the thermal expansion ratio of the metal case 62 and the thermal expansion ratio of the acoustic matching member 64. Due to such a structure, the bonding face is prevented from being flexed and the acoustic matching member 64 is prevented from coming off from the metal case 62. Thus, an ultrasonic transmitting and receiving device whose characteristic is little changed in accordance with the temperature can be provided.

In the example shown in FIG. 22, the first layer 65 is formed of silver solder, the second layer 66 is formed of titanium, and the third layer 67 is formed of glass. The bonding member 60 has a structure which is resistant against corrosion even in a gas containing sulfur or the like. Due to such a structure, an ultrasonic transmitting and receiving device having a long life can be provided.

Figure 23:
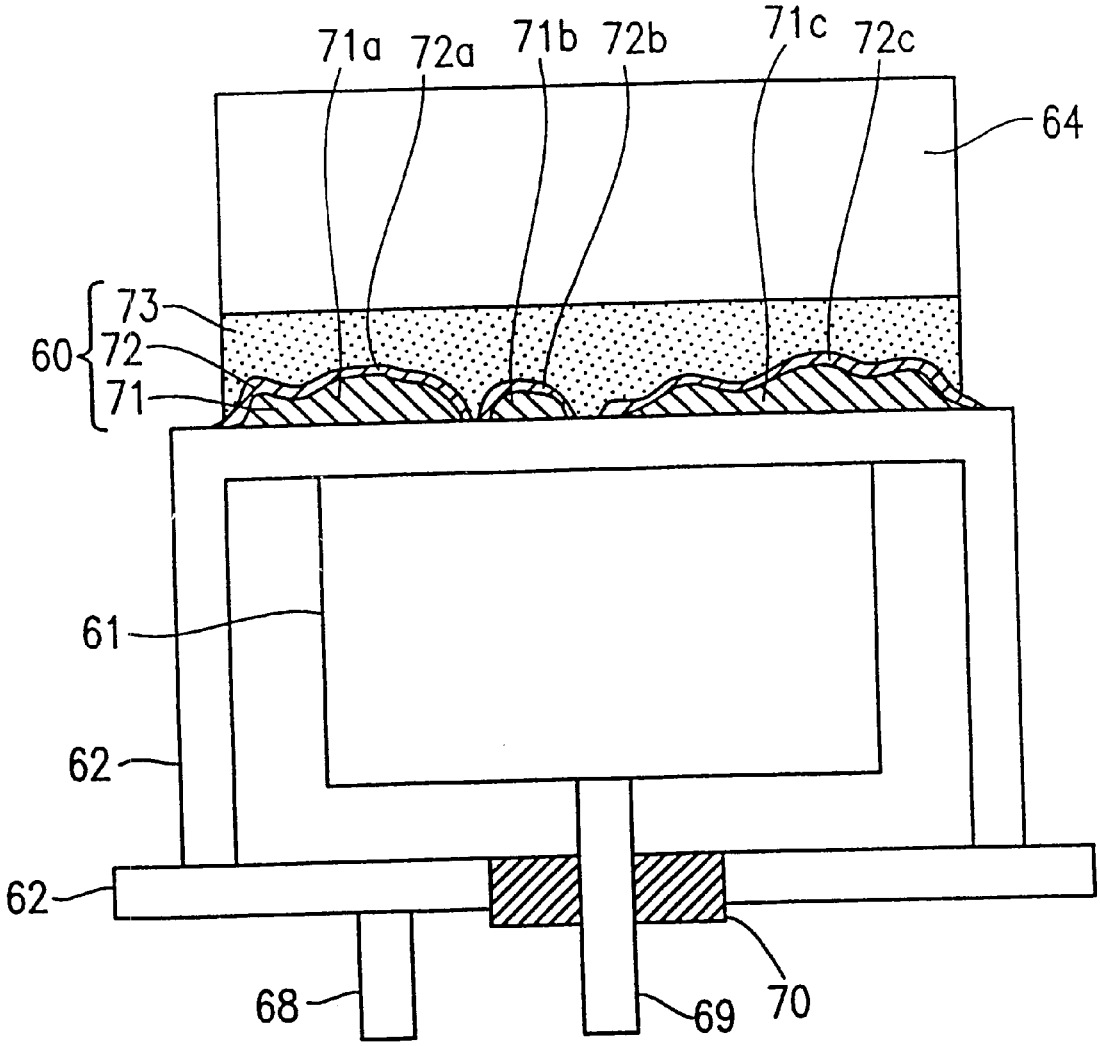
FIG. 23 shows another exemplary structure of an ultrasonic transmitting and receiving device according to the eighth example of the present invention.

FIG. 23 shows another exemplary structure of an ultrasonic transmitting and receiving device according to the eighth example of the present invention. The ultrasonic transmitting and receiving device shown in FIG. 23 has a structure for reducing more stress applied on the bonding member 60 than the ultrasonic transmitting and receiving device shown in FIG. 22.

The bonding member 60 includes a first layer 71 formed on the metal case 62, a second layer 72 formed of first layer 71, an a third layer 73 formed on the second layer 72.

The first layer 71 is formed on the metal case 62 intermittently. In other words, the first layer 71 is divided into a plurality of partial layers. In the example shown in FIG. 23, the first layer 71 is divided into partial layers 71*a*, 71*b* and 71*a*. One face of each of the partial layers 71*a*, 71*b* and 71*c* is bonded to the metal case 62, and the other face of each of the partial layers 71*a*, 71*b* and 71*c* has a convexed and concaved shape. Hereinafter, the face having the convexed and concaved shape will be referred to as a "convexed and concaved face".

The second layer 72 is formed on the first layer 71 intermittently. In other words, the second layer 72 is divided into a plurality of partial layers. In the example shown in FIG. 23, the second layer 72 is divided into partial layers 72*a*, 72*b* and 72*c*. The partial layer 72*a* is formed along the convexed and concaved face of the partial layer 71*a*. The partial layer 72*b* is formed along the convexed and concaved face of the partial layer 71*b*. The partial layer 72*c* is formed along the convexed and concaved face of the partial layer 71*c*.

By forming the first layer 71 and the second layer 72 intermittently as described above, the change of the shape can be restricted to be small even when the thermal expansion ratio is large. Thus, the stress applied on the bonding face of the second layer 72 and the third layer 73 can be reduced. In addition, the changes of the shape of the partial layers existing intermittently can counteract each other, and thus the stress applied on the bonding face of the second layer 72 and the third layer 73 can be reduced.

In the example shown in FIG. 23, the first layer 71 and the second layer 72 are formed intermittently. Therefore, the third layer 73 and the metal case 62 contact each other in a part of the metal case 62. However, the contact area between the third layer 73 and the metal case 62 is very small, and therefore the third layer 73 and the metal case 62 can be bonded together even when the layer 73 and the case 62 are significantly different in thermal expansion ratio. Even when the layer 73 and the case 62 cannot be bonded together, the influence of the non-contact state on the propagation of the vibration (sound) is negligible because the contact area is very small.

The operation and function of the ultrasonic transmitting and receiving device shown in FIG. 23 are similar to the operation and function of the ultrasonic transmitting and receiving device shown in FIG. 22 and will not be described here.

By forming the first layer 71 intermittently, the stress applied on the bonding member 60 can be reduced. This allows the acoustic matching member 64 to be formed of a material having a smaller thermal expansion ratio than that of glass. As a result, an ultrasonic transmitting and receiving device whose output characteristic is little changed in accordance with the temperature can be provided.

Figure 24:
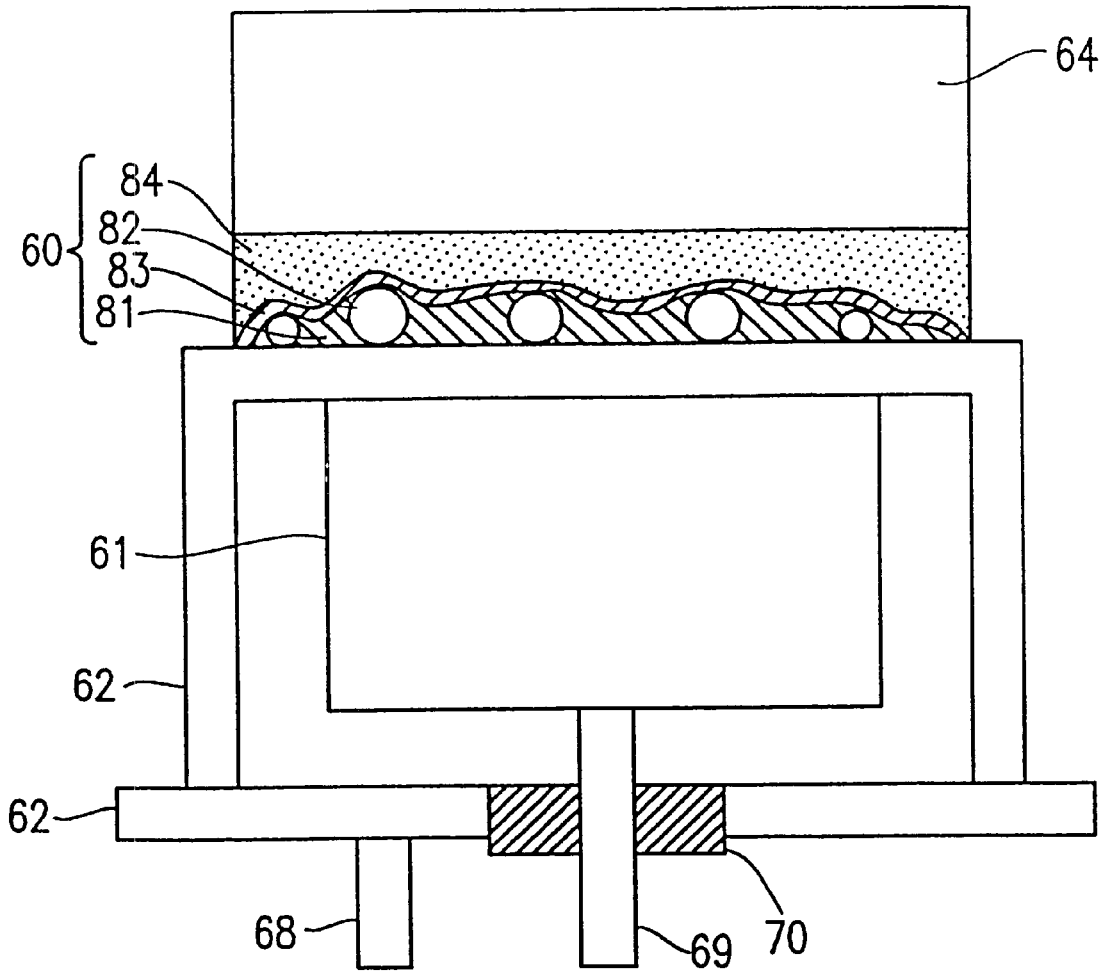
FIG. 24 shows still another exemplary structure of an ultrasonic transmitting and receiving device according to the eighth example of the present invention.

FIG. 24 shows still another exemplary structure of an ultrasonic transmitting and receiving device according to the eighth example of the present invention.

The bonding member 60 includes a first layer 81 formed on the metal case 62, a second layer 82 formed on the first layer 81, an a third layer 83 formed on the second layer 82.

The bonding member 60 shown in FIG. 24 has the same structure as that of the bonding member 60 shown in FIG. 22 except that the former includes a plurality of alumina particles 82.

The alumina particles 82 have a thermal expansion ratio of 6 to $7\times10^{-6}$ $K^{-1}$, which is significantly lower than that of the silver solder used for forming the first layer 81. Therefore, the alumina particles 82 have the shape thereof hardly changed. Thus, the entire change of the shape of the first layer 81 can be reduced.

Use of different sizes of alumina particles 82 has an advantage of facilitating the formation of a convexed and concaved face of the first layer 81.

Figure 25:
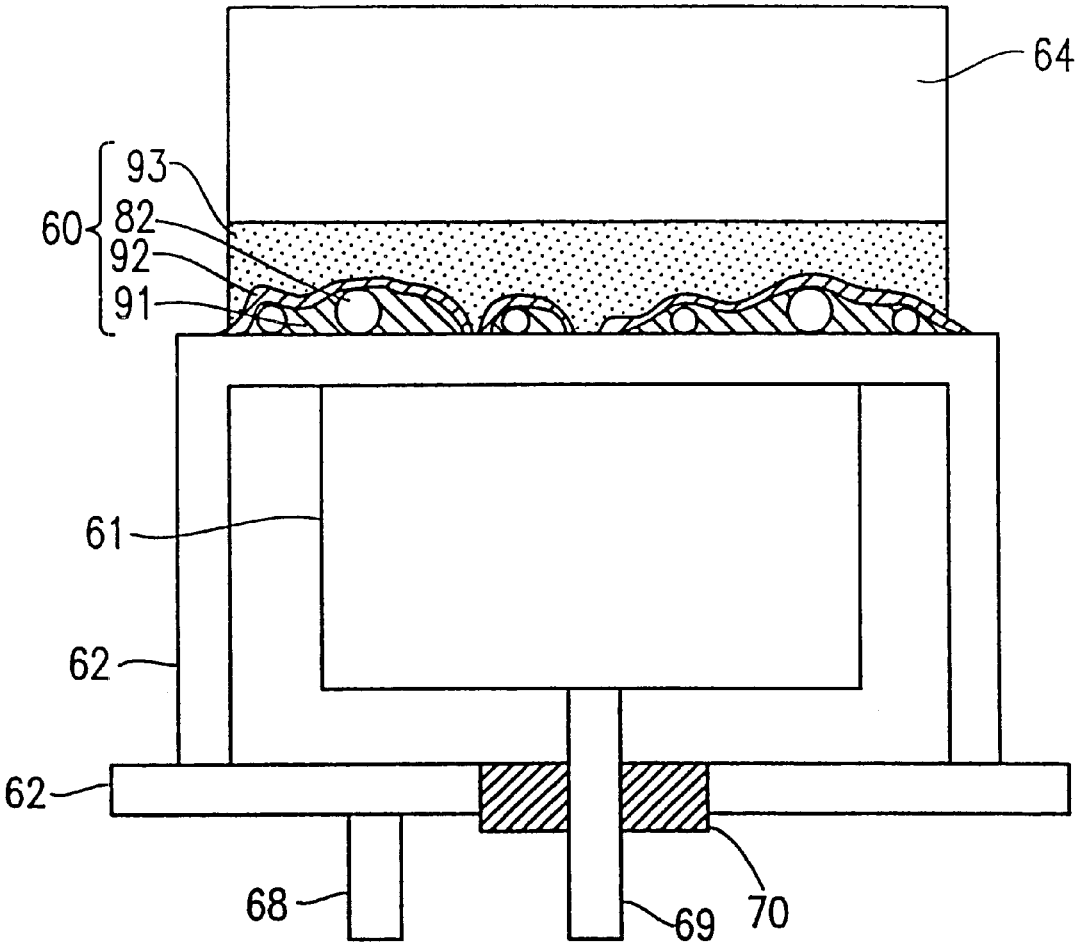
FIG. 25 shows still another exemplary structure of an ultrasonic transmitting and receiving device according to the eighth example of the present invention.

FIG. 25 shows another exemplary structure of an ultrasonic transmitting and receiving device according to the eighth example of the present invention. The ultrasonic transmitting and receiving device shown in FIG. 25 has a structure for reducing more stress applied on the bonding member 60 than the ultrasonic transmitting and receiving device shown in FIG. 24.

The bonding member 60 includes a first layer 91 formed on the metal case 62, a second layer 92 formed of first layer 91, and a third layer 93 formed on the second layer 92.

The bonding member 60 shown in FIG. 25 has the same structure as that of the bonding member 60 shown in FIG. 24 except that the former includes the first layer 91 and the second layer 92 formed intermittently.

By forming the first layer 91 and the second layer 92 intermittently as described above, the change of the shape can be restricted to be small even when the thermal expansion ratio is large. In addition, the changes of the shape of the partial layers existing intermittently can counteract each other.

Accordingly, in the ultrasonic transmitting and receiving device shown in FIG. 25, first, the stress applied on the bonding face of the first layer 91 and the second layer 92 can be reduced. Second, the stress applied on the bonding face of the second layer 92 and the third layer 93 can be reduced. As a result, the stress applied on the bonding member 60 shown in FIG. 25 can be smaller than the stress applied on the bonding member 60 shown in FIG. 24.

By forming the first layer 91 intermittently, the stress applied on the bonding member 60 can be reduced. This allows the acoustic matching member 64 to be formed of a material having a smaller thermal expansion ratio than that of glass. As a result, an ultrasonic transmitting and receiving device whose characteristic is little changed in accordance with the temperature can be provided.

EXAMPLE 9

Figure 26:
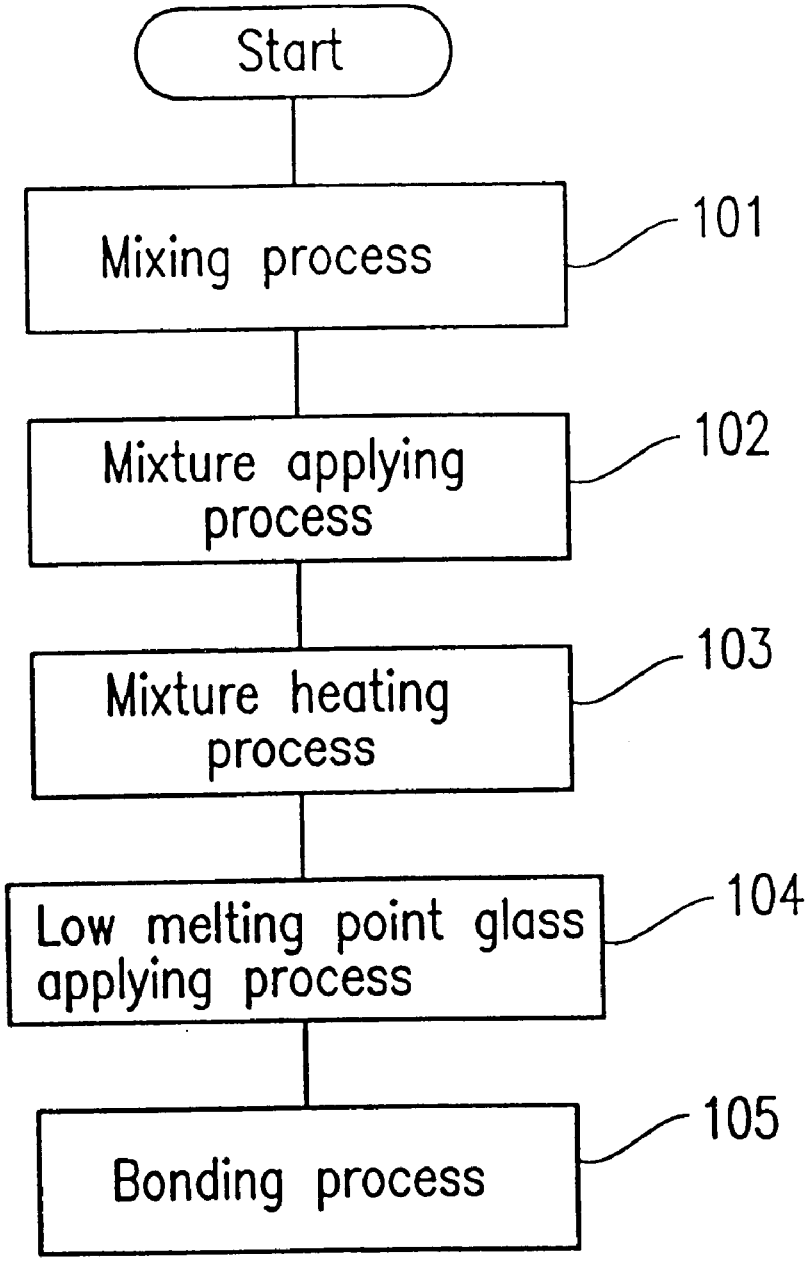
FIG. 26 is a flowchart illustrating a procedure of a bonding method according to a ninth example of the present invention.

FIG. 26 shows a procedure of a bonding method according to a ninth example of the present invention. Following the procedure shown in FIG. 26, the acoustic matching member 64 and the metal case 62 of the ultrasonic transmitting and receiving device shown in FIG. 22 are bonded together via the bonding member 60.

In step 101 (a mixing process), particles of silver solder used for forming the first layer 65 and particles of titanium used for forming the second layer 66 are mixed at a prescribed ratio, thereby forming a mixture.

In order to cause the distribution of the materials in the mixture to be uniform, it is preferable to add a solidification assisting agent formed of a viscous resin material. For example, a solidification assisting agent having a significantly lower melting point than that of silver, copper or titanium can be used. In this case, the solidification assisting agent is preferably vaporized before the silver solder used for forming the first layer 65 is melted.

In step 102 (a mixture applying process), the mixture is applied to the metal case 62.

In step 103 (a mixture heating process), the metal case 62 having the mixture applied thereto is placed in a vacuum furnace and heated.

In step 104 (a low melting point glass applying process), the metal case 62 having the first layer 65 and the second layer 66 applied thereto is removed from the vacuum furnace, and low melting point glass used for forming the third layer 67 is applied to the second layer 66. By mixing the solidification assisting agent formed of a resin material with the low melting point glass, the low melting point glass can be uniformly applied.

In step 105 (a bonding process), the acoustic matching member 64 is placed on the low melting point glass, and heated to about 450° C. in an atmosphere while being supplied with a load of about 30 g. The low melting point glass is melted and thus bonded with the titanium oxide film of the second layer 66 and also bonded with the glass of the acoustic matching member 64. Since the glass of the acoustic matching member 64 is softened at a temperature of 600° C. or higher, the glass of the acoustic matching member 64 is not melted at 450° C.

Particles of a plurality of materials having different thermal expansion ratios are mixed so as to produce a mixture, and the mixture is melted. In this manner, a bonding member having a plurality of layers having different thermal expansion ratios can be formed.

In the ninth example, titanium is used as a material which is especially easy to oxidize. Silver solder is used as a material having a specific gravity larger than that of titanium. Titanium has a density of 4.54 g/cm$^3$, and an alloy of silver and copper has a density of 9 to 10 g/cm$^3$. When a mixture of these materials is melted, titanium floats on the silver solder, and thus titanium is oxidized. In this manner, a film of titanium oxide can be formed on the silver solder layer.

In the ninth example, in step 103 (mixture heating process), the mixture is heated at about 800 to 900° C. This heating temperature is sufficiently lower than the melting point of titanium, which is 1650° C., but is higher than the melting point of silver solder. Therefore, titanium can be floated on the liquid of silver solder. The floating titanium reacts with oxygen in the vacuum furnace and thus is melted, and as a result, a film of titanium oxide is formed. In this manner, the second layer 66 is formed.

In the ninth example, the size of particles of titanium, which is easily oxidized, is set to be 150 $\mu$m or less. Thus, titanium reacts with oxygen and thus is melted without being heated to the melting point of titanium. As a result, a film of titanium oxide as thin as several micrometers can be formed.

In the ninth example, titanium as a material which is easily oxidized has a thermal expansion ratio at 20° C. of $8.6\times10^{-6}$ K$^{-1}$. Silver solder having a larger specific gravity than that of titanium has a thermal expansion ratio at 20° C. of 15 to $17\times10^{-6}$ K$^{-1}$. That is, the formation of a titanium film having a small thermal expansion ratio causes the second layer 66, the first layer 65 and the metal case 62 to have step-wise thermal expansion ratios. Thus, the stress generated by the difference between the thermal expansion ratio of the low melting point glass used for forming the third layer 67 and the thermal expansion ratio of the stainless steel used for forming the metal case 62 can be reduced. Therefore, even when the acoustic matching member 64 is formed of glass, the acoustic matching member 64 and the metal case 62 can be bonded together.

Figure 27:
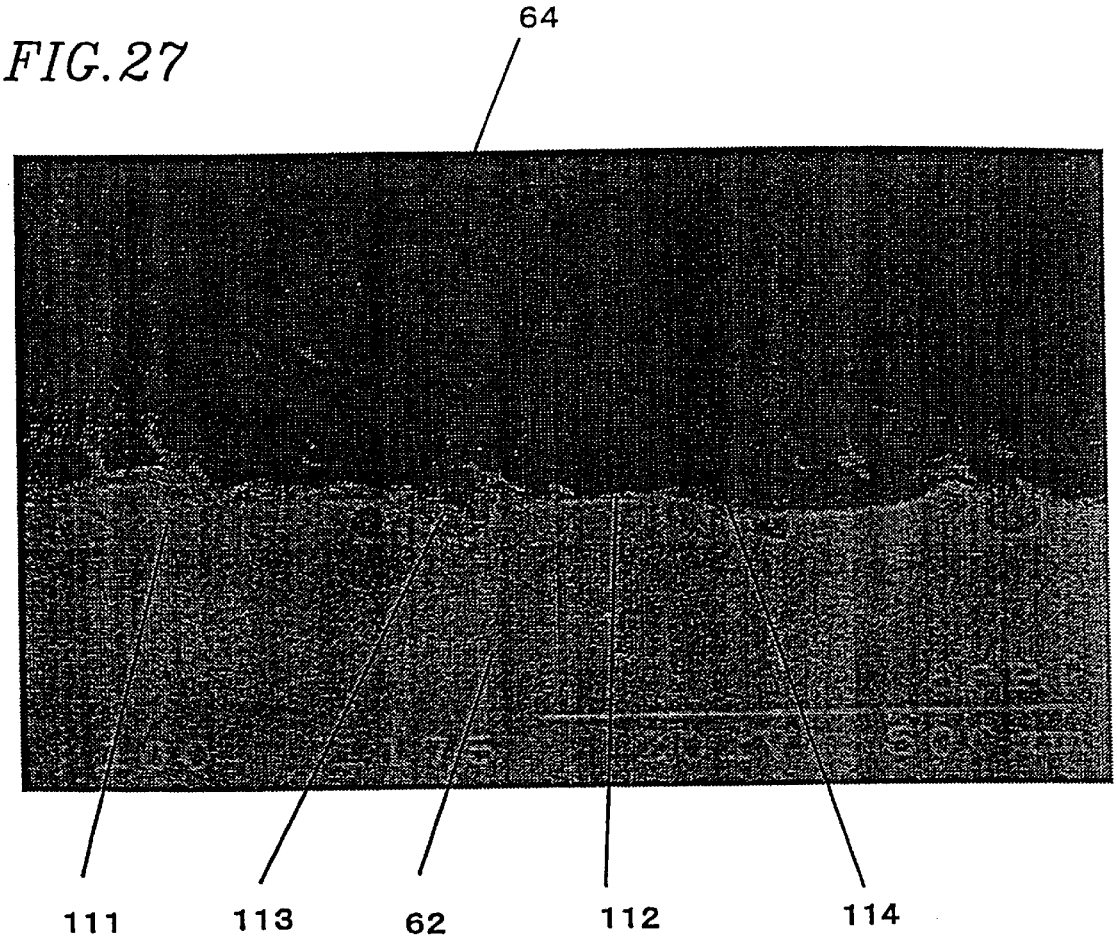
FIG. 27 shows a cross-section of a main part of an ultrasonic transmitting and receiving device produced by bonding an acoustic matching member 64 and a metal case 62 in accordance with the procedure shown in FIG. 26.

FIG. 27 shows a cross-section of a main part of an ultrasonic transmitting and receiving device produced by bonding the acoustic matching member 64 and the metal case 62 in accordance with the procedure shown in FIG. 26.

In FIG. 27, reference numeral 62 represents a stainless steel metal case. Reference numeral 111 represents a silver solder layer (a first layer), reference numeral 112 represents a titanium oxide layer (a second layer), reference numeral 113 represents alumina particles, and reference numeral 114 represents a low melting point glass layer (a third layer). Reference numeral 64 represents a glass acoustic matching member.

Here, the silver solder layer 111 and the titanium oxide layer 112 are formed to have a convexed and concaved face by scattering the alumina particles 113 in the silver solder layer 111.

As can be appreciated from FIG. 27, the metal case 62 and the silver solder layer 111 are bonded together with no gap. The silver solder layer 111 and the titanium oxide layer 112 are also bonded together with no gap.

When a mixture containing silver solder particles and titanium particles is melted, the silver solder particles and the titanium particles are bonded together in a softened state. As a result, the two layers can be bonded with no gap at the bonding face. By forming the convexed and concaved faces using the alumina particles 113, the stress applied on the titanium oxide layer 112 and the low melting point glass layer 114 can be reduced.

The alumina particles 113 has a thermal expansion ratio of 6 to $7\times10^{-6}$ K$^{-1}$, which is lower than that of silver solder. When the alumina particles 113 are contained in the silver solder layer 111, the silver solder layer 111 locally has a low thermal expansion ratio. Thus, the thermal expansion ratio of the entire silver solder layer 111 can be reduced. As a result, the stress applied on the low melting point glass layer 114 is reduced.

The convexed and concaved face of the bonding face can diversify the direction of the stress applied on the bonding face. Thus, the stress applied on the low melting point glass layer 114 can be reduced. Since the low melting point glass and the glass of the acoustic matching member 64 have about the same thermal expansion ratio, substantially no stress is applied on the bonding face between the low melting point glass layer 114 and the acoustic matching member 64.

Due to the above-described structure, the acoustic matching member 64 and the bonding member 60 for bonding the acoustic matching member 64 and the metal case 62 can be formed of a material having a low thermal expansion ratio. Thus, the change of the characteristic of the ultrasonic transmitting and receiving device in accordance with the temperature can be decreased.

In the ninth example, titanium, specifically, can be reacted with nitrogen or carbon so as to form a titanium nitride film or a titanium carbide film as the second layer 66. In this case, the titanium nitride film or the titanium carbide film have the same effect as the titanium oxide film. The titanium nitride film can be formed by heating a mixture containing titanium particles and silver solder particles in a nitrogen atmosphere. The composition of the film can be set in accordance with the composition of a material with which the film is bonded.

In the above-described examples, a gas is used as an example of a subject of measurement. Alternatively, a liquid can be a subject of measurement.

INDUSTRIAL APPLICABILITY

In an acoustic matching member according to the present invention, at least one of a plurality of fine pieces is bonded with at least another of the plurality of fine pieces at a contact portion, so as to form a gap in the acoustic matching member. By bonding the fine pieces at the contact portion, the contact area between the fine pieces is increased. Thus, the coupling between the fine pieces can be enhanced. This provides an effect of reducing the attenuation of vibration at the coupling point of the fine pieces. Therefore, the vibration of the vibrator can be efficiently transferred to a fluid as a subject of measurement.

In the case where the fine pieces have an amorphous three-dimensional structure, the gap formed in the acoustic matching member can be enlarged. Thus, the density of the acoustic matching member can be lower than the inherent density of the material of the fine pieces. As a result, the acoustic impedance of the acoustic matching member can be reduced. Therefore, the vibration of the vibrator can be efficiently transferred to a fluid as a subject of measurement.

In the case where the fine pieces are located so as not to propagate the sound linearly through the acoustic matching member, the sonic speed allowed by the acoustic matching member can be decreased. As a result, the acoustic impedance of the acoustic matching member can be reduced. Therefore, the vibration of the vibrator can be efficiently transferred to a fluid as a subject of measurement.

In the case where the fine pieces are formed of glass or ceramic materials, an acoustic matching member having a low thermal expansion ratio and a stable temperature characteristic can be provided. Thus, an ultrasonic transmitting and receiving device having a high precision can be realized. The above-obtained acoustic matching member is resistant against corrosion caused by impurities such as, for example, sulfur contained in a gas.

By a method for producing an acoustic matching member according to the present invention, a plurality of fine pieces are bonded together by heating the fine pieces to a temperature for softening the material of the fine pieces. An adhesive formed of an epoxy resin or the like does not need to be used for producing the acoustic matching member. The acoustic matching member can be lighter by the weight of the adhesive. Thus, the acoustic impedance of the acoustic matching member can be reduced. Therefore, the vibration of the vibrator can be efficiently transferred to a fluid as a subject of measurement.

In an ultrasonic transmitting and receiving device according to the present invention, a bonding member for bonding a metal case for accommodating the vibrator and the acoustic matching member has a structure for reducing the difference between the thermal expansion ratio of the metal case and the thermal expansion ratio of the acoustic matching member. Thus, the metal case and the acoustic matching member having different thermal expansion ratios can be bonded stably without using an adhesive based on a resin such as, for example, an epoxy resin.

What is claimed is:

1. An acoustic matching member used, when a sound is propagated from a first object to a second object, for matching an acoustic impedance of the first object and an acoustic impedance of the second object, wherein:

the acoustic matching member includes a plurality of fine pieces, at least one of the plurality of fine pieces is bonded with at least another of the plurality of fine pieces at a contact portion so as to form a gap in the acoustic matching member, and a size of the gap is sufficiently small as compared to a wavelength of the sound to be propagated.

2. An acoustic matching member according to claim 1, wherein the plurality of fine pieces each have an amorphous three-dimensional structure.

3. An acoustic matching member according to claim 1, wherein the plurality of fine pieces are located so as to prevent the sound from being linearly propagated through the acoustic matching member.

4. An acoustic matching member according to claim 1, wherein the plurality of fine pieces are each formed of a glass or a ceramic material.

5. An ultrasonic transmitting and receiving device, comprising:

a vibrator;

metal case for accommodating the vibrator;

an acoustic matching member used for matching an acoustic impedance of the vibrator and an acoustic impedance of a fluid flowing outside the metal case; and a bonding member for bonding the acoustic matching member and the metal case, wherein:

the acoustic matching member includes a plurality of fine pieces, and at least one of the plurality of fine pieces is bonded with at least another of the plurality of fine pieces at a contact portion so as to form a gap in the acoustic matching member, a size of the gap is sufficiently small as compared to a wavelength of the sound to be propagated, and the bonding member has a structure for reducing a difference between a thermal expansion ratio of the metal case and a thermal expansion ration of the acoustic matching member.

6. An ultrasonic transmitting and receiving device according to claim 5, wherein the bonding member includes a first layer formed on the metal case, a second layer formed on the first layer, and a third layer formed on the second layer; the first layer is formed of silver solder; the second layer is formed of titanium; and the third layer is formed of silver solder.

7. An ultrasonic transmitting and receiving device according to claim 6, wherein the bonding member further includes a fourth layer formed on the third layer and a fifth layer formed on the fourth layer; the fourth layer is a ceramic plate or a glass plate; and the fifth layer is formed of glass having a melting point lower than a melting point of the material of the fourth layer.

8. An ultrasonic transmitting and receiving device according to claim 5, wherein the bonding member includes a first layer formed on the metal case, and the first layer is formed based on a mixture obtained by mixing silver solder powder and titanium powder.

9. An ultrasonic transmitting and receiving device according to claim 5, wherein the bonding member includes a first layer formed on the metal case, and the first layer is formed based on a mixture obtained by mixing silver solder powder, titanium powder and ceramic powder.

10. An ultrasonic transmitting and receiving device according to claim 5, wherein the bonding member includes a first layer formed on the metal case and a second layer formed on the first layer, and a bonding face between the first layer and the second layer has a convexed and concaved shape.

11. An ultrasonic transmitting and receiving device according to claim 10, wherein the first layer is formed on the metal case intermittently.

12. An ultrasonic transmitting and receiving device according to claim 10, wherein the first layer contains a plurality of particles having a thermal expansion ratio lower than a thermal expansion ratio of the material of the first layer.

13. An ultrasonic transmitting and receiving device according to claim 5, wherein:

the bonding member includes a first layer formed on the metal case and a second layer formed on the first layer, and the first layer is formed by heating a mixture containing a first particle of a first material which is easily oxidized, nitrided or carbided and a second particle of a second material having a specific gravity larger than a specific gravity of the first material and having a melting point lower than a melting point of the first material, the first layer being formed as a layer of the second material; and the second layer is formed on the layer of the second material, the second layer being formed as a layer obtained as a result of oxidizing, nitriding or carbiding the first material.

14. An ultrasonic transmitting and receiving device according to claim 13, wherein the first material has a thermal expansion ratio which is lower than a thermal expansion ratio of the second material.

15. An ultrasonic transmitting and receiving device according to claim 13, wherein the mixture is heated at a temperature which is lower than the melting point of the first material and higher than the melting point of the second material.

16. An ultrasonic transmitting and receiving device according to claim 13, wherein the first particle has a size of 150 $\mu$m or less.

* * * * *